US008020638B2

(12) United States Patent
Chellappa et al.

(10) Patent No.: US 8,020,638 B2
(45) Date of Patent: Sep. 20, 2011

(54) SEAL WITH DYNAMIC SEALING SURFACE AT THE OUTSIDE DIAMETER

(75) Inventors: Sudarsanam Chellappa, Houston, TX (US); Zhou Yong, Spring, TX (US)

(73) Assignee: Smith International, Inc., Houston, TX (US)

( * ) Notice: Subject to any disclaimer, the term of this patent is extended or adjusted under 35 U.S.C. 154(b) by 559 days.

(21) Appl. No.: 11/554,141

(22) Filed: Oct. 30, 2006

(65) Prior Publication Data

US 2008/0099244 A1 May 1, 2008

(51) Int. Cl.
*E21B 10/00* (2006.01)
*E21B 10/22* (2006.01)

(52) U.S. Cl. ..... 175/371

(58) Field of Classification Search ..... 175/371, 175/372, 228, 227; 384/94
See application file for complete search history.

(56) References Cited

U.S. PATENT DOCUMENTS 2,462,596 A * 2/1949 Bent ..... 277/451
3,467,448 A * 9/1969 Galle ..... 277/589
3,489,421 A 1/1970 Neilson
3,529,840 A * 9/1970 Kupfert et al. ..... 277/383
3,663,073 A 5/1972 Bronson
3,746,405 A 7/1973 Welton
4,248,484 A 2/1981 Newcomb
4,316,515 A 2/1982 Pessier
4,394,020 A * 7/1983 Oelke ..... 277/306
4,428,588 A 1/1984 Oelk
4,428,687 A 1/1984 Zahradnik
4,429,854 A 2/1984 Kar et al.
4,466,622 A 8/1984 Deane et al.
4,537,409 A * 8/1985 Estes et al. ..... 277/503
4,560,175 A 12/1985 Kar et al.
4,610,452 A * 9/1986 DiRienz ..... 175/371
4,722,404 A 2/1988 Evans
4,822,057 A 4/1989 Chia et al.
4,824,123 A 4/1989 Chia et al.
5,362,073 A * 11/1994 Upton et al. ..... 277/589
5,456,327 A 10/1995 Denton et al.
5,472,058 A 12/1995 Hooper et al.
5,513,711 A 5/1996 Williams
5,842,700 A 12/1998 Fang et al.
5,842,701 A * 12/1998 Cawthorne et al. ..... 277/336
RE36,452 E 12/1999 Upton et al.
6,026,917 A 2/2000 Zahradnik et al.
6,033,117 A 3/2000 Cariveau et al.
6,123,337 A 9/2000 Fang et al.
6,142,249 A 11/2000 Zahradnik et al.
6,170,830 B1 * 1/2001 Cawthorne et al. ..... 277/336
(Continued)

FOREIGN PATENT DOCUMENTS

GB 2354027 3/2001
(Continued)

*Primary Examiner* — Kenneth Thompson
*Assistant Examiner* — Cathleen R Hutchins

(57) ABSTRACT

A seal assembly for sealing between a journal shaft and a rotating cone cutter of a drill bit. In an embodiment, the seal assembly comprises a seal gland positioned between the journal shaft and the cone cutter. In addition, the seal assembly comprises an annular seal body disposed about the journal shaft within an annular recess. The seal body comprises a dynamic sealing surface at its outer diameter $D_1$ that forms a dynamic seal with the sealing surface of the recess and a static sealing surface at its inner diameter $D_2$ that forms a static seal with an outer bearing surface of the journal shaft.

38 Claims, 12 Drawing Sheets

U.S. PATENT DOCUMENTS

| | | | | |
|---|---|---|---|---|
| 6,176,331 | B1 | 1/2001 | Jin et al. | |
| 6,179,296 | B1 | 1/2001 | Cawthorne et al. | |
| 6,196,339 | B1 | 3/2001 | Portwood et al. | |
| 6,209,185 | B1 | 4/2001 | Scott | |
| 6,254,275 | B1 | 7/2001 | Slaughter, Jr. et al. | |
| 6,264,367 | B1 | 7/2001 | Slaughter, Jr. et al. | |
| 6,305,483 | B1 * | 10/2001 | Portwood | 175/371 |
| 6,357,540 | B1 | 3/2002 | Page et al. | |
| 6,427,790 | B1 | 8/2002 | Burr | |
| 6,474,424 | B1 | 11/2002 | Saxman | |
| 6,513,607 | B2 | 2/2003 | Peterson et al. | |
| 6,536,542 | B1 * | 3/2003 | Fang et al. | 175/371 |
| 6,598,690 | B2 | 7/2003 | Peterson | |
| 6,684,966 | B2 | 2/2004 | Lin et al. | |
| 6,752,223 | B2 | 6/2004 | Panigrahi et al. | |
| 6,837,317 | B2 | 1/2005 | Byrd | |
| 6,976,548 | B2 | 12/2005 | Neville et al. | |
| 7,036,613 | B2 | 5/2006 | Burr | |
| 7,117,961 | B2 * | 10/2006 | Yong et al. | 175/371 |
| 2002/0108788 | A1 | 8/2002 | Peterson et al. | |
| 2003/0029645 | A1 * | 2/2003 | Mourik et al. | 175/372 |
| 2003/0075363 | A1 | 4/2003 | Lin et al. | |
| 2004/0238226 | A1 | 12/2004 | Lin | |
| 2005/0023042 | A1 * | 2/2005 | Yong et al. | 175/372 |
| 2005/0056462 | A1 | 3/2005 | Burr | |
| 2005/0274550 | A1 * | 12/2005 | Yu et al. | 175/372 |
| 2006/0032673 | A1 * | 2/2006 | Yong et al. | 175/372 |
| 2006/0096782 | A1 | 5/2006 | Neville et al. | |
| 2008/0011518 | A1 * | 1/2008 | Zahradnik et al. | 175/372 |
| 2008/0041635 | A1 * | 2/2008 | Peterson | 175/371 |
| 2008/0073124 | A1 * | 3/2008 | Lin | 175/371 |

FOREIGN PATENT DOCUMENTS

| | | |
|---|---|---|
| WO | 98/15703 | 4/1998 |
| WO | 9815709 | 4/1998 |
| WO | 02066781 | 8/2002 |

* cited by examiner

SEAL WITH DYNAMIC SEALING SURFACE AT THE OUTSIDE DIAMETER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. Field of the Invention

The invention relates generally to seal assemblies for sealing between a rotating and a static member. In one particular aspect, the invention relates to seals for rolling cone bits used to drill a borehole for the ultimate recovery of oil, gas or minerals. In a more particular aspect, the invention relates to seals that are employed to seal and protect the bearing surfaces between a rolling cone cutter and the journal shaft on which it rotates.

2. Background of the Invention

An earth-boring drill bit is typically mounted on the lower end of a drill string. With weight applied to the drill string, the drill string is rotated such that the bit engages the earthen formation and proceeds to form a borehole along a predetermined path toward a target zone.

A typical earth-boring bit includes one or more rotatable cone cutters. The cone cutters roll and slide upon the bottom of the borehole as the drillstring and bit are rotated, the cone cutters thereby engaging and disintegrating the formation material in their path. The rotatable cone cutters may be described as generally conical in shape and are therefore referred to as rolling cones.

Rolling cone bits typically include a bit body with a plurality of journal segment legs. The rolling cones are mounted on bearing pin shafts (also called journal shafts or pins) that extend downwardly and inwardly from the journal segment legs. As the bit is rotated, each cone cutter is caused to rotate on its respective journal shaft as the cone contacts the bottom of the borehole. The borehole is formed as the action of the cone cutters removes chips of formation material ("cuttings" or "drilled solids") which are carried upward and out of the borehole by the flow of drilling fluid which is pumped downwardly through the drill pipe and out of the bit. Liquid drilling fluid is normally used for oil and gas well drilling, whereas compressed air is generally used as the drilling fluid in mining operations.

Seals are positioned in glands formed between the rolling cones and their journal shafts to prevent lubricant from escaping from around the bearing surfaces and to prevent the cutting-laden, abrasive drilling fluid from entering between the cone and the shaft and damaging the bearing surfaces. When cuttings and/or abrasives are conveyed into the seal gland, they tend to adhere to the gland and/or seal component surfaces, and may cause deformation, damage and/or slippage of the seal components. Moreover, the cuttings can accelerate abrasive wear of all seal components and of the bearing surfaces.

In oil and gas drilling, the cost of drilling a borehole is proportional to the length of time it takes to drill to the desired depth and location. The time required to drill the well, in turn, is greatly affected by the number of times the drill bit must be changed before reaching the targeted formation. This is the case because each time the drill bit wears out or fails as a borehole is being drilled, the entire string of drill pipes, which may be miles long, must be retrieved from the borehole, section by section in order to replace the bit. Once the drill string has been retrieved and the new bit installed, the bit must be lowered to the bottom of the borehole on the drill string, which again must be constructed section by section. The amount of time required to make a round trip for replacing a bit is essentially lost from drilling operations. As is thus obvious, this process, known as a "trip" of the drill string, requires considerable time, effort and expense. It is therefore advantageous to maximize the service life of a drill bit. Accordingly, it is always desirable to employ drill bits that will be durable enough to drill for a substantial period of time with acceptable rate of penetration (ROP).

The durability of a bit and the length of time that a drill bit may be employed before it must be changed depend upon numerous factors. Importantly, the seals must function for substantial periods under extremely harsh downhole conditions. The type and effectiveness of the seals greatly impact bit life and thus, are critical to the success of a particular bit design.

One cause of bit failure arises from the severe wear or damage that may occur to the bearings on which the cone cutters are mounted. These bearings can be friction bearings (also referred to as journal bearings) or roller type bearings, and are typically subjected to high drilling loads, high hydrostatic pressures, and high temperatures.

As previously mentioned, the bearing surfaces in typical bits are lubricated. Seals between the journal shaft and the rotating cone mounted to the journal shaft serve to retain lubricant within the bit and prevent cutting-laden and abrasive drilling fluid from passing to the bit bearings. The seal is typically in the form of a ring disposed between the journal shaft and the rotating cone mounted to the journal shaft. Further, the seal typically includes a dynamic seal surface placed in rotating contact against the journal shaft surface, and a static seal surface that engages the rotating cone. In other words, this conventional seal rotates along with the cone relative to the journal shaft. Although the bit will experience severe and changing loading, as well as a wide range of different temperature and pressure conditions, the dynamic and static seal surfaces must nevertheless remain sealingly engaged in order to prevent the lubricant from escaping and/or cuttings from entering the lubricated areas, and should perform these duties throughout the life of the bit's cutting structure.

A variety of seal types are known in the art. These include O-ring type seals made of rubber or other elastomeric material. The service life of bits equipped with such elastomeric seals is generally limited by the ability of the seal material to maintain sealing engagement at each dynamic and static seal surface while withstanding the different temperature and pressure conditions at each dynamic and static seal surface.

The conditions at the dynamic seal surface of the seal are often more harsh than the conditions at the static seal surface. This is typically the case because the relative motion at the dynamic seal surface often results in increased friction, increased temperatures, increased abrasion, and increased wear. Consequently, failure of most conventional seals occurs at the dynamic seal surface that dynamically engages the journal shaft. Failure of the seal at the journal shaft surface may undesirably provide a relatively direct path for entrance of cutting-laden drilling fluid into the inner workings of the rock bit.

Internal pressures within rock bits are caused by the elevated temperatures that occur within a bit during operation, as well as the elevated temperature of the downhole environment. In some deep hole drilling applications, internal rock bit temperatures can go as high as 300° F. and beyond. During any drilling operation the pressure of drilling mud external the rock bit may be higher than 10,000 psi (~68 MPa). This pressure is typically equalized within a bit by the pressure compensation subassembly, so that the annular seal has substantially equivalent pressure acting on both the mud side (i.e., the side of the annular seal positioned adjacent the bit external environment) and the bearing side (i.e., the side of the annular seal positioned distal the external environment and adjacent the bit bearing) of the seal. This pressure equalization is important for purposes of maintaining proper seal positioning within the seal gland in the bit.

However, in some cases, an unchecked differential pressure may arise and exert an undesired pressure force on the seal in an axial direction within the seal gland within which it is seated. The direction that the seal is urged depends on whether the bit external or internal pressure is controlling, which will depend on the particular bit design, drilling application and operating conditions. In situations where the bit external pressure is controlling, the annular seal will be forced inwardly within the seal gland in an axial direction along the journal axis. In situations where the bit internal pressure is controlling, the annular seal will be forced axially outwardly within the seal gland towards the bit external environment. In either case, if a sufficient pressure differential exists between the internal and external pressures, a sidewall portion of the seal may be urged and extruded into a clearance or groove extending from the seal gland that is formed between the cone and journal shaft. The portions of the seal that extrude into the clearance or groove adjacent the seal gland may become pinched between the rotating cone and static journal shaft, potentially leading to "nibbling" and/or excessive wear or damage to the seal. Due to the relative movement and harsher conditions encountered at dynamic seals, portions of the seal proximal dynamic seal surfaces are especially susceptible to undesirable extrusion and nibbling.

The internal temperatures within the drill bit, especially the temperature of sealing surfaces that engage seals between the journal shaft and the rotating cone mounted to the journal shaft, can impact the performance, wear, and lifetime of such seals within the drill bit. For instance, temperatures in excess of 250° to 300° F. may result in undesirable breakdown of elastomeric seals. In addition, higher seal temperatures generally cause the seal to expand. The expansion of the seal may result in increased engagement, friction, and wear at the dynamic seal surface, which in turn further increase the seals temperatures. This viscous cycle may result in relatively quick temperature increases in the seal, rapid wear of the seal, and eventually failure of the seal. In addition, excessive temperatures may result in undesirable breakdown in lubricant flowing between the journal shaft and rolling cone mounted to the journal shaft.

In many conventional multi-seal arrangements, a primary seal and a secondary seal are disposed proximal one another between the journal shaft and the rotating count mounted to the journal shaft. Traditionally, both the primary seal and secondary seal are oriented with their dynamic seal surface engaging the journal shaft. As previously described, heat generation and temperatures at dynamic seal surfaces are generally greater than static seal surfaces. By positioning the dynamic seal surfaces of both the primary and secondary seals adjacent one another against the journal shaft, the temperature of the journal shaft proximal the dynamic seal surfaces may increase beyond the desirable operating temperature range. The increased temperature of the journal shaft may lead to premature breakdown and/or failure of the primary and/or secondary seal.

It is therefore desirable that a new, durable and long lasting seal assembly be devised, one including long life, relative insensitivity to high temperatures and pressures, and enhanced protection of dynamic seal surfaces, but one that is not as susceptible to damage caused by extrusion and nibbling.

Accordingly, to provide a drill bit with better performance and longer life, and thus to lower the drilling costs incurred in the recovery of oil and other valuable resources, it would be desirable to provide a seal that has the potential to provide longer life than conventional elastomeric seals. Preferably, such seals would provide a bit that will drill with acceptable ROP for longer periods so as to increase bit life and increase in footage drilled as compared to bits employing conventional seals.

SUMMARY OF EXEMPLARY PREFERRED EMBODIMENTS

In accordance with at least one embodiment of the invention, a seal assembly for sealing between a journal shaft and a rotating cone cutter of a drill bit comprises a seal gland positioned between the journal shaft and the cone cutter. The seal gland comprises an annular recess that includes a sealing surface. In addition, the seal assembly comprises an annular seal body disposed about the journal shaft within the annular recess. The seal body comprises a dynamic sealing surface at its outer diameter $D_1$ that forms a dynamic seal with the sealing surface of the recess and a static sealing surface at its inner diameter $D_2$ that forms a static seal with an outer bearing surface of the journal shaft.

In accordance with another embodiment of the invention, a drill bit for drilling through earthen formations comprises a bit body including an extending journal shaft having an outer bearing surface. In addition, the drill bit comprises a rolling cone cutter rotatably mounted on the journal shaft. The rolling cone cutter includes an inner bearing surface adjacent the outer bearing surface of the journal shaft. Further, the drill bit comprises a first seal assembly positioned between the rolling cone cutter and the journal shaft. The first seal assembly comprises a first annular recess including a sealing surface formed in the inner bearing surface of the rolling cone cutter. Moreover, the first seal assembly comprises a first annular seal body positioned around the journal shaft within the first annular recess. The first annular seal body comprises a radially outer dynamic sealing surface that sealingly engages the sealing surface of the first annular recess and a radially inner static sealing surface that sealingly engages the outer bearing surface of the journal shaft.

In accordance with another embodiment of the invention, a method for sealing between a journal shaft and a rotating cone cutter of a drill bit comprises forming an annular recess in an inner surface of the cone cutter, wherein the recess includes a sealing surface. In addition, the method comprises disposing an annular seal body about the journal shaft within the recess. The annular seal body comprises a radially outer sealing surface that sealingly engages the sealing surface of the recess and a radially inner sealing surface that sealingly engages an outer surface of the journal shaft. Further, the method comprises applying a torque $T_1$ to the seal body at the interface of the outer sealing surface of the seal body and the sealing surface of the recess. Still further, the method comprises applying a torque $T_2$ to the seal body at the interface of the inner sealing surface of the seal body and the outer surface of the journal shaft, wherein $T_2$ is greater than $T_1$.

Embodiments described herein thus comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiments of the present invention, reference will now be made to the accompanying drawings, wherein.

DETAILED DESCRIPTION OF EXEMPLARY PREFERRED EMBODIMENTS

Figure 1:
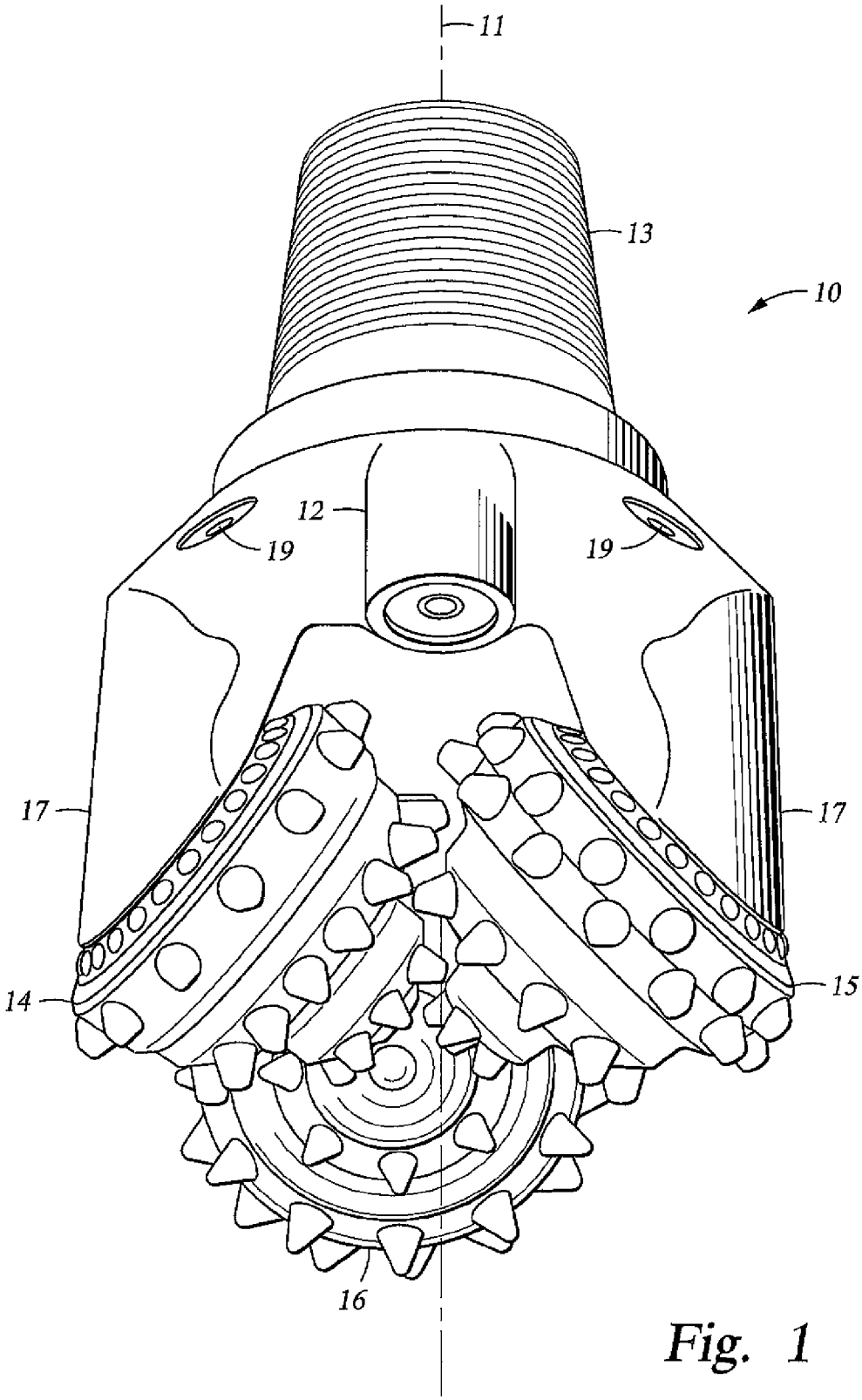
FIG. 1 is a perspective view of an exemplary earth boring bit.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other or intermediate devices and connections.

Referring now to FIG. 1, an earth-boring bit 10 includes a central axis 11 and a bit body 12. Body 12 includes a threaded portion 13 on its upper end for securing bit 10 to the drillstring (not shown). In this embodiment, bit body 12 is composed of three sections or legs 17 that are joined together to form bit body 12. Rotatably connected to body 12 are three rolling cone cutters 14, 15, 16. Each cone cutter 14-16 is rotatably mounted on a journal pin or shaft 18 (FIG. 2) that is oriented generally downward and inward toward the center of bit 10. Each journal shaft 18 and each cone cutter 14-16 is substantially the same, such that the description of one such journal shaft 18 and one cone cutter 14 will adequately describe the others.

It is to be understood that seal assemblies are described herein with respect to a three cone bit for purposes of example only, and that the seal assemblies described herein may be employed in single cone bits, as well as in bits having two or more cones. Likewise, the seal assemblies described herein may have application beyond drill bits, and may be used wherever a seal is required to seal between a shaft and a rotatable member mounted on the shaft.

Figure 2:
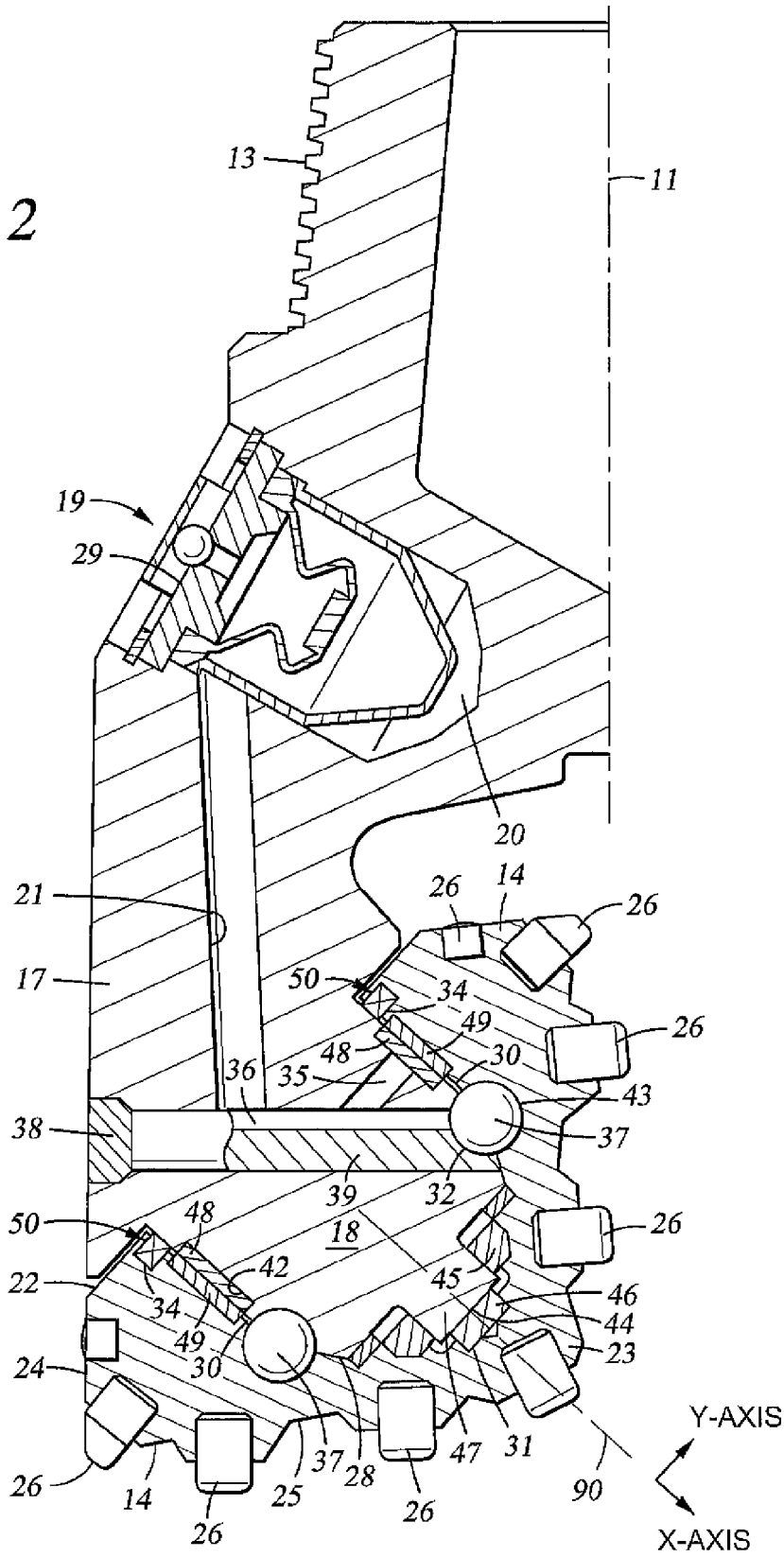
FIG. 2 is a partial cross-sectional view taken through one leg and one rolling cone cutter of the bit of FIG. 1.

Referring to FIG. 2, exemplary cone cutter 14 further includes a central axis 90, a backface 22 and a nose portion 23 generally opposite backface 22. Cone 14 also includes a frustoconical heel surface 24 and a generally conical surface 25 extending between heel surface 24 and nose 23. Secured within heel surface 24 and conical surface 25 are protruding cutter elements which, as depicted in FIGS. 1 and 2, comprise inserts 26, such as inserts made of tungsten carbide and/or diamond coated inserts. Although not shown, embodiments of the seal assemblies described herein may likewise be employed advantageously in "steel tooth" bits, also sometimes referred to as "milled tooth" bits, where the cutter elements are formed from the cone material, such as by a milling process, and coated with a hard-facing material.

It is to be understood that the terms "radial" and "radially" define positions and/or movement relative to, and substantially perpendicular to, the central axis (e.g., axis 90) of a rolling cone cutter (e.g., cone 14). Further, the terms "axial" and "axially" define positions and/or movement relative to, and substantially parallel to, the central axis (e.g., axis 90) of a rolling cone cutter (e.g., cone 14). For instance, the y-axis illustrated in FIG. 2 generally defines radial positions relative to central axis 90 of cone 14, and the x-axis illustrated in FIG. 2 generally defines axial positions.

Referring still to FIG. 2, cone 14 includes a central cavity or bore 28, which receives journal shaft 18. Central bore 28 includes a bearing surface 30 and end surface 31. Formed in bearing surface 30 is a circumferential groove 43 for receiving a plurality of locking balls 37.

Journal shaft 18 includes a bearing surface 42 that is substantially concentric to bearing surface 30 of cone 14. In some regions where bearing surfaces 30, 42 do not contact each other, a clearance groove or passage 33 may form therebetween. Bearing surface 42 includes a groove 32 for receiving locking balls 37. A ball passageway 36 intersects groove 32 and forms a means by which locking balls 37 are placed into cone 14 during assembly. Locking balls 37 retain cone 14 on journal shaft 18. After locking balls 37 are in place, a ball retainer 39 is inserted through ball passageway 36 and an end plug 38 is welded or otherwise secured to close off the ball passageway 36.

Journal shaft 18 further includes a reduced diameter portion 47 and end-surface 44. Bearing surface 42 of journal shaft 18 and bearing surface 30 of cone 14 may include cylindrical inlays 48, 49, respectively, that are disposed in grooves formed in the respective parts for reducing friction, such inlays being made, for example, of aluminum bronze alloys. A nose bushing 45 is disposed about reduced diameter portion 47 of journal shaft 18. Cone 14 is disposed over pin 18 with nose button 46 positioned between end-surface 44 and end portion 31 of central bore 28.

Seal assembly 50, shown schematically in FIG. 2 and described in more detail below, is disposed about pin 18 so as to seal between cone 14 and journal shaft 18. In this embodiment, seal assembly 50 is generally positioned adjacent to backface 22 of cone 14. Although one seal assembly 50 is illustrated in FIG. 2, in other embodiments, two or more seal assemblies (e.g., seal assemblies 50) may be provided to seal between cone 14 and journal shaft 18.

The bearing structure described and shown FIG. 2 is generally known as a journal bearing. Other types of bits, particularly bits having larger diameters and bits designed for higher rotational speeds, may include roller bearings disposed between the journal shaft and the cone cutter. It is to be understood that embodiments of the seal assemblies described herein can be employed in all types of rotary cone bits, including journal bearing and roller bearing bits, and in both rock bits and mining bits.

Bearing surfaces 30, 42 of cone 14 and journal shaft 18, respectively, are lubricated by grease. The grease is applied so as to fill the regions adjacent to the bearing surfaces and to fill various interconnected passageways such that, upon bit assembly, air is essentially excluded from the interior of the bit. The bit includes a grease reservoir 19, including a pressure compensation subassembly 29 and a lubricant cavity 20, which is connected to the ball passageway 36 by lubricant passageway 21. The grease is retained in bit 10, the bearing structure, and the various passageways, including diagonal passageway 35 and passageways 21, 36, by means of seal assembly 50. Likewise, seal assembly 50 prevents drilled cuttings and abrasive drilling fluid external to bit 10 from passing seal assembly 50 and washing out the lubricant and potentially damaging the bearing surfaces.

Figure 3:
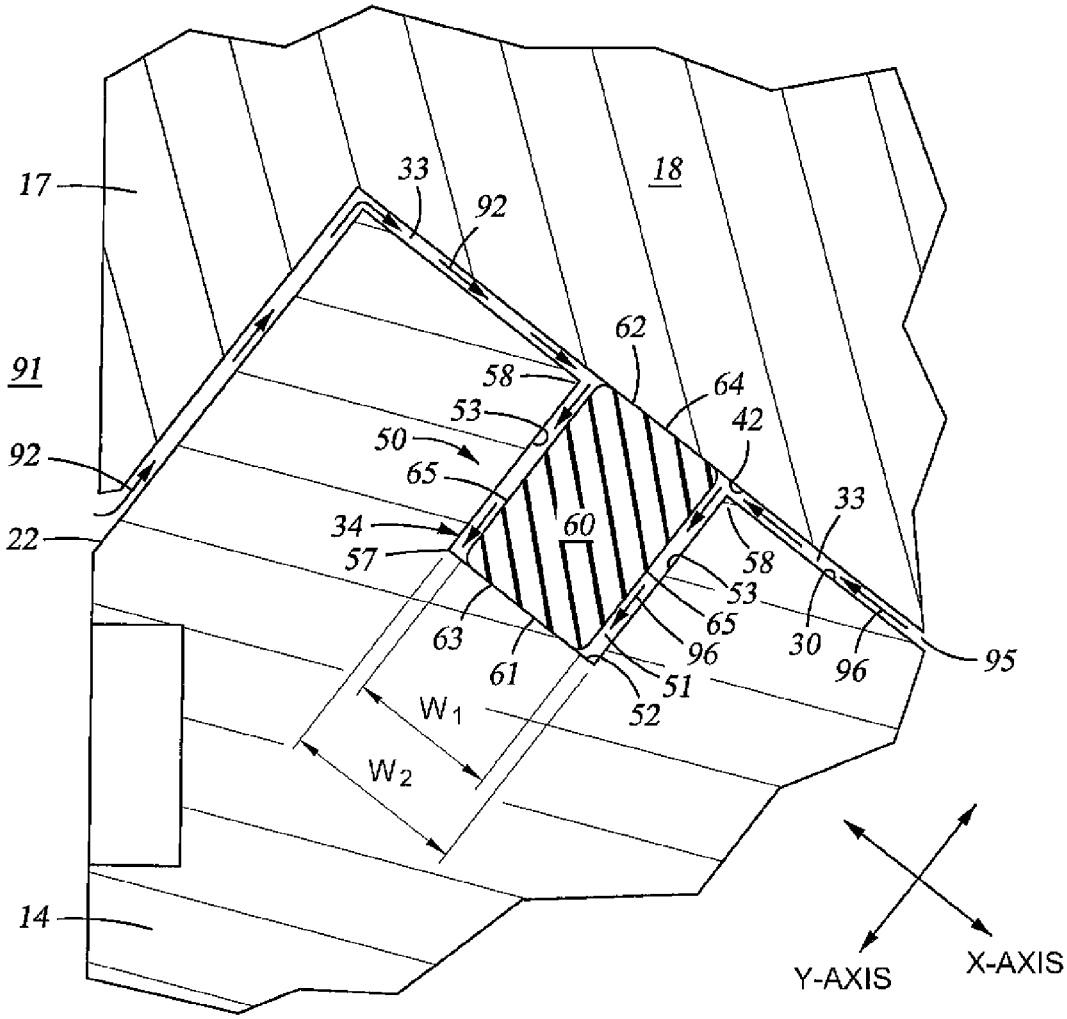
FIG. 3 is an enlarged cross-sectional view of an embodiment of the seal assembly of FIG. 2 sealing between the rolling cone cutter and the journal shaft of the bit.

Referring now to FIG. 3, an embodiment of seal assembly 50 generally includes an annular seal body 60. As will be described in more detail below, seal body 60 may be referred to as "static" because it is substantially static in relation to journal shaft 18 and bit body 17 (i.e., annular seal body 60 is not intended to rotate about journal shaft 18). Thus, cone 14 is intended to rotate about journal shaft 18 relative to bit body 17 and relative to seal body 60. Seal body 60 includes a radially outer sealing surface 61, a radially inner sealing surface 62 opposite radially outer sealing surface 61, and seal sidewalls 65 extending between therebetween. For convenience, radially outer sealing surface 61 and radially inner sealing surface 62 may be referred to as outer sealing surface 61 and inner sealing surface 62, respectively. In this embodiment, seal body 60 has a generally rectangular cross-section.

Annular seal body 60 is retained within a seal gland 51, generally comprising an annular recess 34 in cone 14. Recess 34 includes a sealing surface 52 and a pair of annular surfaces 53 extending between bearing surface 30 of cone 14 and sealing surface 52. In this embodiment, sealing surface 52 is cylindrical and faces journal shaft 18, and thus, may be referred to as a cylindrical shaft-facing surface. Further, in this embodiment, annular surfaces 53 are generally planar and substantially parallel, however, in other embodiments, annular surfaces may be non-parallel and/or non-planar. Each annular surface 53 intersects sealing surface 52 to form an annular corner 57. Further, each annular surface 53 intersects bearing surface 30 to form an annular corner 58. In this embodiment, annular surfaces 53 of recess 34 are substantially parallel and generally perpendicular to cone axis 90. As best shown in FIG. 3, seal gland 51 is further defined by cylindrical bearing surface 42 of journal shaft 18.

Referring still to FIG. 3, outer sealing surface 61 of seal body 60 engages sealing surface 52 of recess 34 to form an outer seal 63. Further, inner sealing surface 62 of seal body 60 engages bearing surface 42 of journal shaft 18 to form an inner seal 64.

In this embodiment, seal sidewalls 65 do not contact annular surfaces 53 of recess 34, resulting in a void or gap G between seal sidewalls 65 and annular surfaces 53. In particular, referring briefly to FIGS. 3-5, seal body 60 has a width $W_1$ measured axially between the outermost portions of seal sidewalls 65. Further, recess 34 has a width $W_2$ measured axially between the outermost portions of annular surfaces 53. Width $W_1$ of seal body 60 is less than width $W_2$ of recess 34 when seal body 60 is in its undeformed state prior to assembly (FIGS. 4 and 5) and when seal body 60 is compressed and deformed within seal gland 51 following assembly (FIG. 3). As used herein, the term "undeformed" is used to describe a seal body (e.g., seal body 60) when it is in its relaxed, unstretched, and uncompressed state generally prior to assembly of the seal assembly (e.g., seal assembly 50). Although this embodiment shows a gap G between each seal sidewall 65 and annular surface 53 of recess 34, in other embodiments, one seal sidewall 65 and annular surface 53 may contact, while a gap G is provided between the other seal sidewall 65 and annular surface 53.

As best shown in FIG. 3, cutting-laden, abrasive drilling fluid 91 will tend to enter bit 10 between bit leg 17 and backface 22. Drilling fluid 91 may then flow toward seal assembly 50 via the clearance groove or passage 33 between bearing surfaces 30, 42 generally in the direction of arrows 92. Any drilling fluid 91 that reaches seal body 60 will generally reside between sidewall 65 nearest backface 22 and annular surface 53 nearest backface 22 (i.e., between the rightmost sidewall 65 and the rightmost annular surface 53 in FIG. 3). Thus, drilling fluid 91 contacts seal body 60 adjacent inner seal 64 and outer seal 63.

Similarly, lubricant 95 within bit 10 may move toward seal assembly 50 the clearance groove or passage 33 between bearing surfaces 30, 42 generally in the general direction of arrows 96. Lubricant 95 that reaches seal body 60 will generally reside between sidewall 65 furthest from backface 22 and annular surface 53 nearest backface 22 (i.e., between the leftmost sidewall 65 and the leftmost annular surface 53 in FIG. 3). Thus, lubricant 95 contacts seal body 60 adjacent inner seal 64 and outer seal 63 on the opposite side as drilling fluid 91. Outer seal 61 and inner seal 62 of seal assembly 50 are intended to maintain the separation of lubricant 95 and drilling fluid 91.

Figure 4:
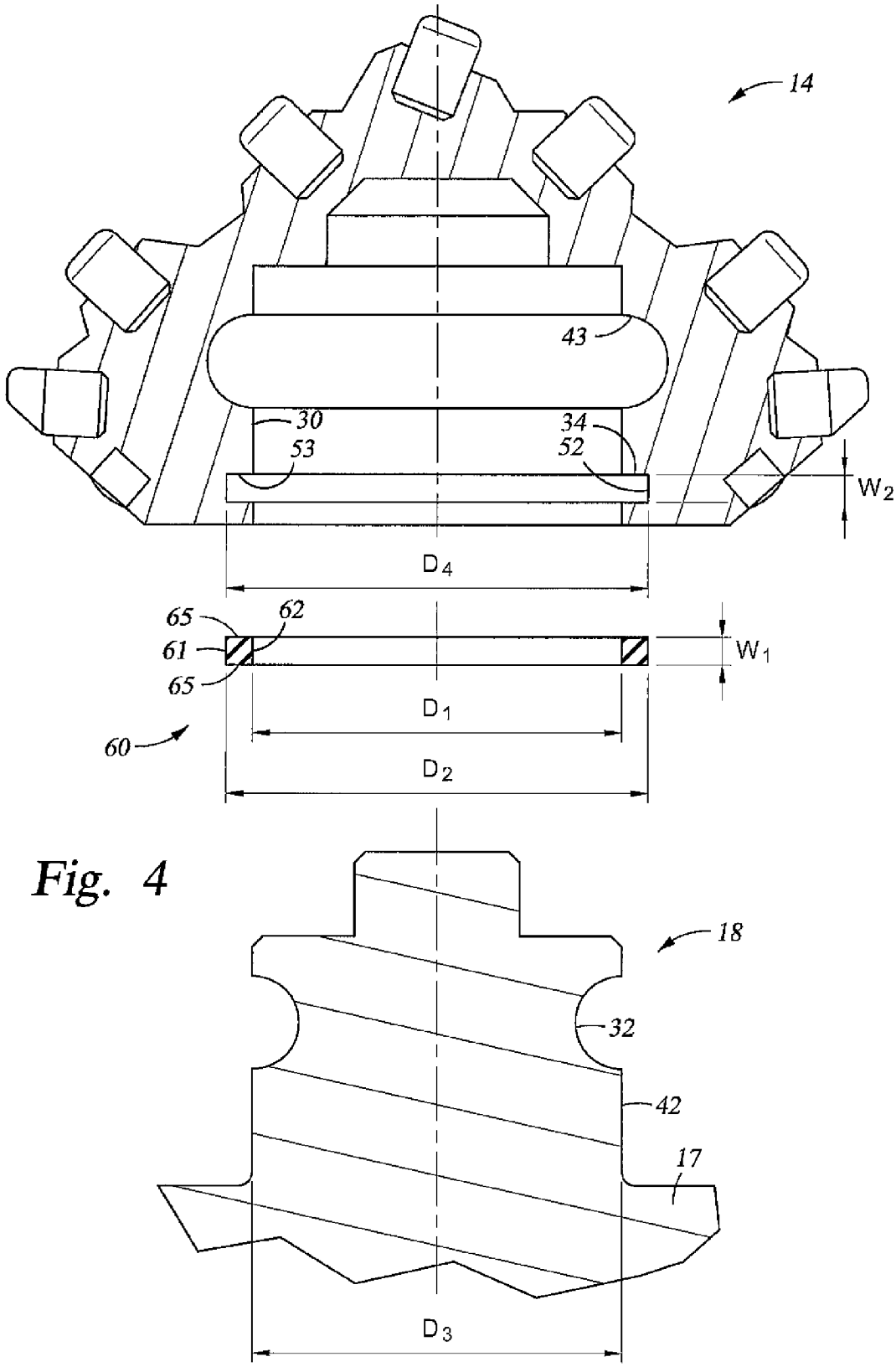
FIG. 4 is an exploded cross-sectional view of the seal assembly of FIG. 3.
Figure 5:
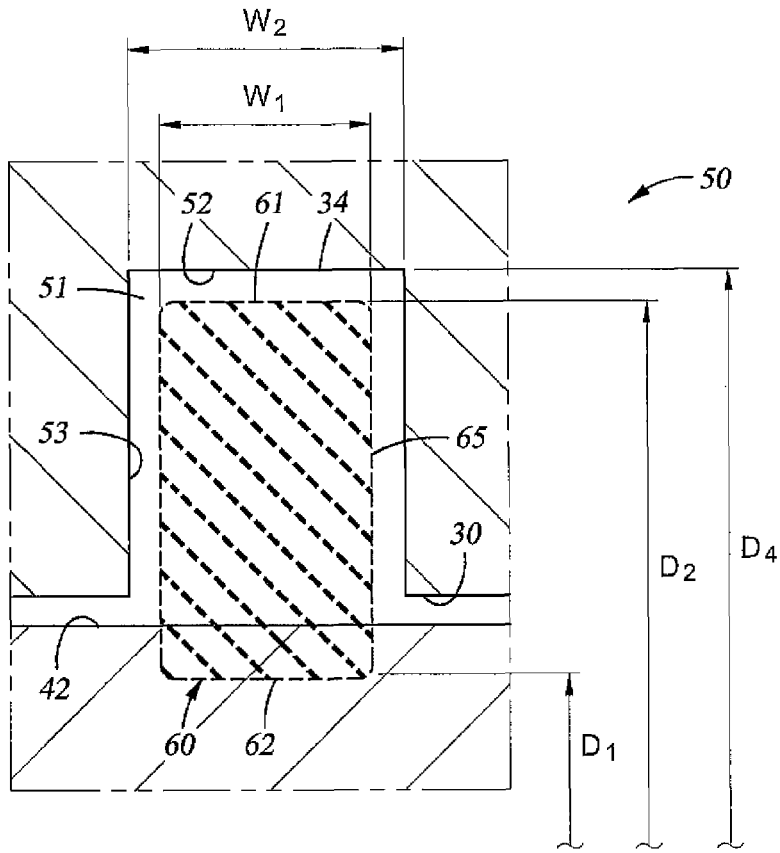
FIG. 5 is an enlarged cross-sectional view of the seal gland and the seal body of the seal assembly of FIG. 2 coaxially aligned with the seal body in its undeformed state prior to assembly.

Referring now to FIGS. 4 and 5, in this embodiment, seal body 60 is generally a ring having an inner diameter $D_1$ defined by annular inner sealing surface 62 and an outer diameter $D_2$ defined by annular outer sealing surface 61. Likewise, journal shaft 18 has an outer diameter $D_3$ defined by bearing surface 42, while recess 34 has an outer diameter $D_4$ defined by sealing surface 52. In its undeformed state prior to assembly, inner diameter $D_1$ of seal body 60 is less than the outer diameter $D_3$ of bearing surface 42, and further, outer diameter $D_2$ of seal body 60 is less than or equal to (e.g., slightly contacts) the outer diameter $D_4$ of sealing surface 52. In FIG. 5, seal body 60 (in phantom) and seal gland 51 are shown coaxially aligned with seal body 60 in its undeformed state prior to assembly.

Figure 6A:
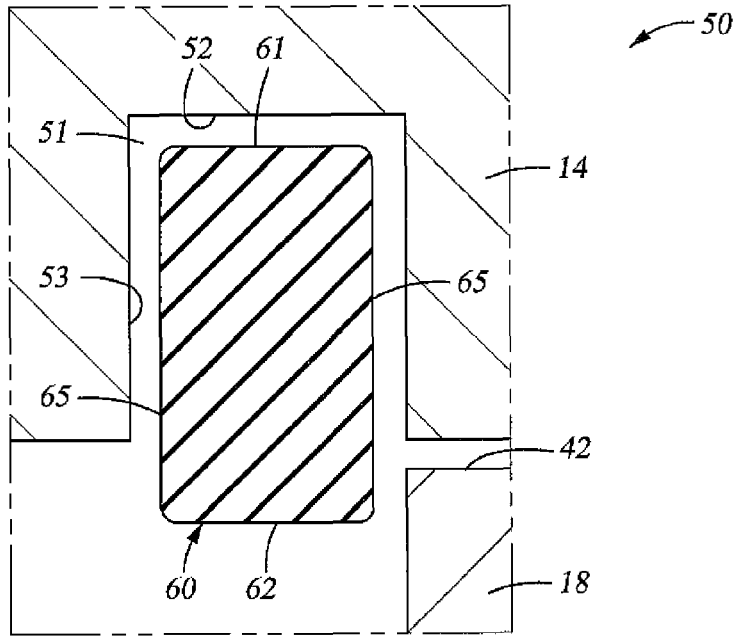
FIGS. 6A to 6C are selected partial cross-sectional views illustrating the assembly of the seal assembly of FIG. 3.
Figure 6B:
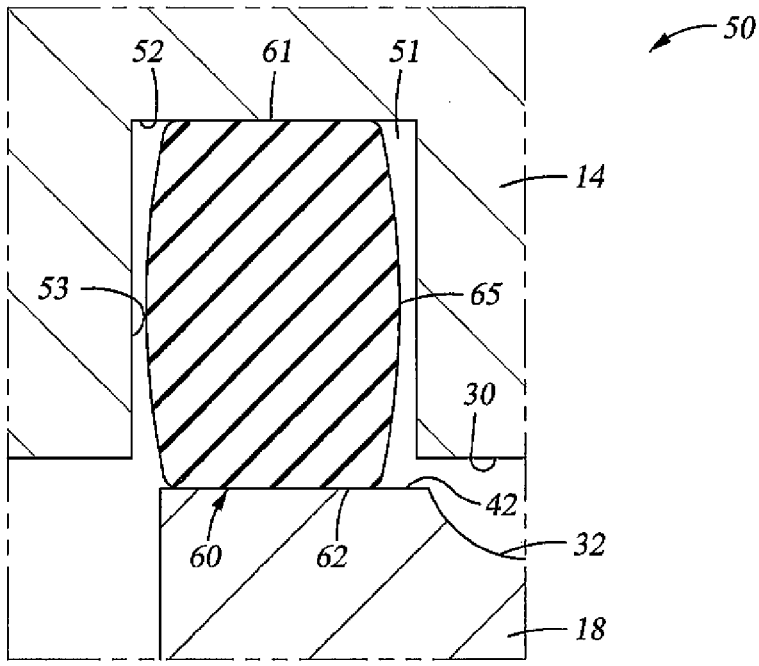
Figure 6C:
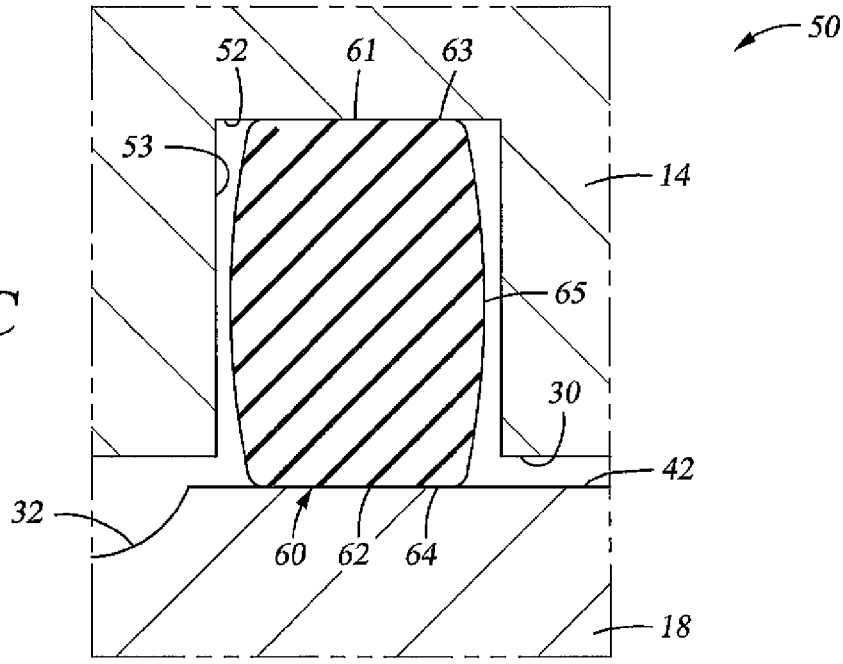

Referring now to FIGS. 4 and 6A-6C, to assemble bit 10, seal body 60 is first positioned within recess 34 of cone 14 in its undeformed state (FIG. 6A). Since the outer diameter $D_2$ of seal body 60 is less than the outer diameter $D_4$ of recess 34 when seal body 60 is in its undeformed state, outer sealing surface 61 of seal body 60 does not yet engage sealing surface 52 of recess 34 (FIG. 6A). Cone 14, with seal body 60 positioned in recess 34, is then pressed onto journal shaft 18 (FIG. 6B). As cone 14 is pressed onto journal shaft 18, seal body 60 stretches around journal shaft 18 since the inner diameter $D_1$ of seal body 60 is less than the out diameter $D_3$ of bearing surface 42 prior to assembly. Consequently, seal body 60 "squeezes" journal shaft bearing surface 42 resulting in an interference fit between journal shaft 18 and seal body 60. As seal body 60 is stretched around journal shaft 18, seal body 60 is urged radially outward resulting in an increase in the outer diameter $D_2$ of seal body 60 (FIG. 6B). The outer diameter $D_2$ of seal body 60 increases until outer sealing surface 61 engages sealing surface 52 of recess 34 (FIG. 6B). Continued urging of seal body 60 outward results in radial compression of seal body 60 between journal shaft 18 and sealing surface 52 (FIGS. 6B and 6C). It should be appreciated that compression and deformation of seal body 60 between journal shaft 18 and sealing surface 52 may advantageously result in increased contact surface area or sealing surface area between inner sealing surface 62 and bearing surface 42 and between outer sealing surface 61 and sealing surface 52.

Stretching of seal body 60 around journal shaft 18 and radial compression of seal body 60 within seal gland 51 may tend to deform seal body 60. For instance, in this embodiment where seal body 60 has a generally rectangular cross-section in its undeformed state prior to assembly, radial compression of seal body 60 causes seal sidewalls 65 to slightly bulge outward. For reasons explained below, although seal sidewalls 65 may bulge outward, at least one seal sidewall 65 preferably does not contact an annular surface 53 of recess 34 when seal assembly 50 is fully assembled. Instead, seal body 60 and seal gland 51 are shaped and dimensioned such that a gap G exists between at least one seal sidewall 65 and annular surface 53. In some embodiments, such as those shown in FIGS. 3 and 6C, gaps G may exist between both seal sidewalls 65 and annular surfaces 53.

It should be appreciated that radial compression of seal body 60 within seal gland 51 (i.e., between journal shaft 18 and sealing surface 52) energizes seal assembly 50, meaning that it tends to bias outer sealing surface 61 firmly towards sealing surface 52 of recess 34, and it tends to bias inner sealing surface 62 firmly towards bearing surface 42.

Figure 7:
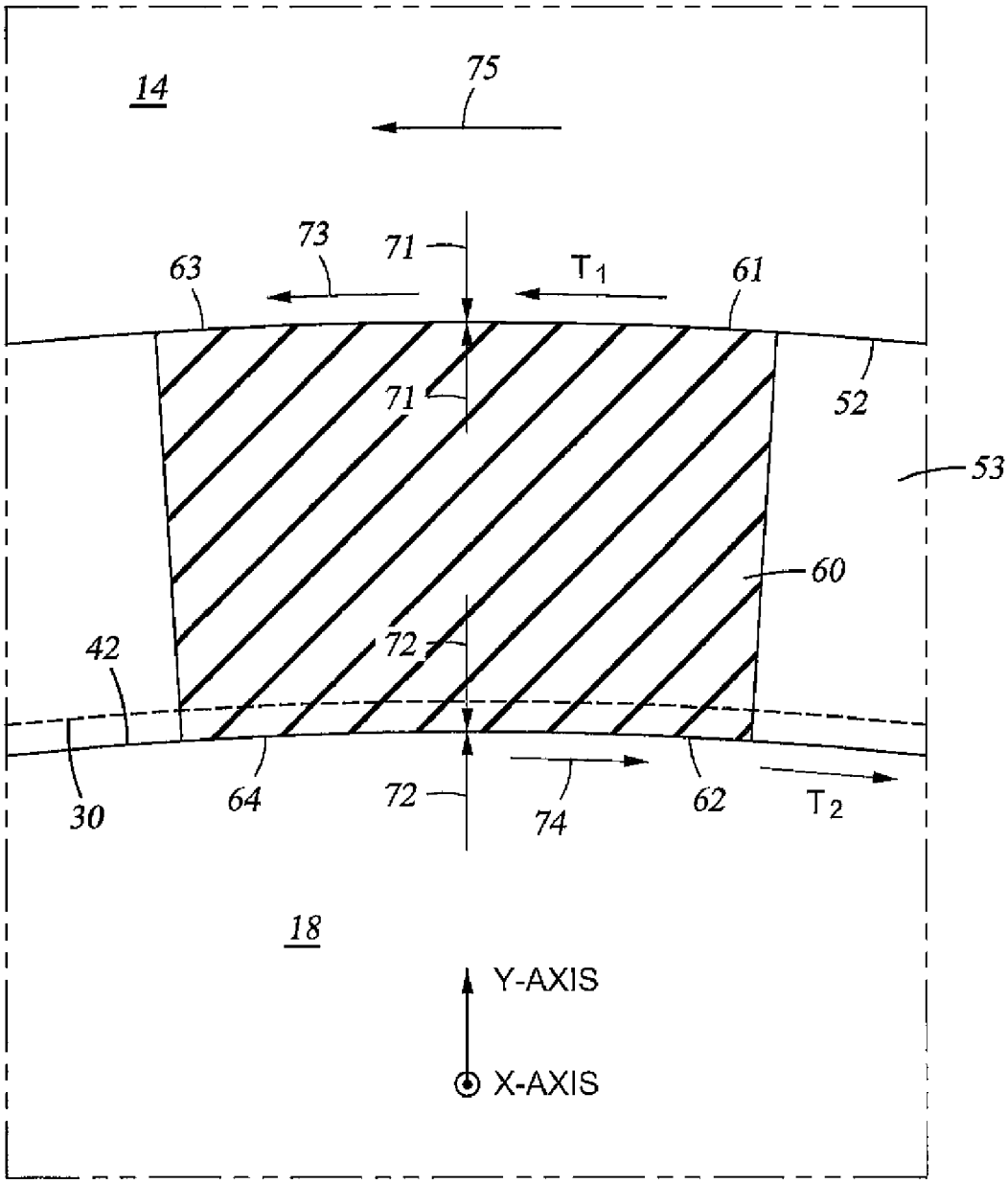
FIG. 7 is an enlarged, partial cross-sectional view a segment of the seal assembly of FIG. 3 schematically illustrating the forces and torques applied to the seal body.

Referring now to FIG. 7, a partial cross-sectional view of a segment of seal body 60 is illustrated. More specifically, this view is taken through a plane passing through seal body 60 substantially perpendicular to cone axis 90. The radial compression of seal body 60 between sealing surface 52 and bearing surface 42 results in substantially equal and opposite radial reactive forces 71 at the interface between outer sealing surface 61 and sealing surface 52 of recess 34. Radial reactive forces 71 tend to urge outer sealing surface 61 and sealing surface 52 towards each other, resulting in the sealing engagement between surfaces 61, 52 at outer seal 63.

In addition, reactive forces 71 give rise to frictional forces 73 acting on seal body 60 at the interface of surfaces 61, 52 that tend to resist relative motion therebetween. In other words, frictional forces 73 seek to maintain static engagement of surfaces 61, 52. Thus, as cone 14 rotates about journal shaft 18 generally in the direction of arrow 75, frictional forces 73 act on seal body 60 in the same direction as the rotation of cone 14, and seek to maintain static engagement of seal body 60 and cone 14 as cone 14 rotates. Although only the frictional forces 73 acting on seal body 60 at the interface of surfaces 61, 52 are illustrated in FIG. 7, it should be understood that frictional forces (not shown) also act on cone 14 at the interface of surfaces 61, 52 as cone 14 rotates.

The interference fit between journal shaft 18 and seal body 60 as well as the compression of seal body 60 within seal gland 51 results in generally equal and opposite radial reactive forces 72 at the interface between inner sealing surface 62 and bearing surface 42 of journal shaft 18. Reactive forces 72 tend to urge inner sealing surface 62 and bearing surface 42 towards each other, resulting in the sealing engagement between surfaces 62, 42 at inner seal 64. In addition, reactive forces 72 give rise to frictional forces 74 acting on seal body 60 at the interface of surfaces 62, 42 that tend to resist relative motion therebetween. In other words, frictional forces 74 seek to maintain static engagement of surfaces 62, 42. Thus, as cone 14 rotates about journal shaft 18 generally in the direction of arrow 75, frictional forces 74 act on seal body 60 opposite to direction of rotation of cone 14, and seek to resist the rotation of seal body 60 relative to journal shaft 18. Although only the frictional forces 74 acting on seal body 60 at the interface of surfaces 62, 42 are illustrated in FIG. 7, it should be understood that frictional forces (not shown) also act on cone 14 at the interface of surfaces 62, 42 as cone 14 rotates. Thus, as cone 14 rotates about journal shaft 18 in the direction of arrow 75, frictional forces 73 acting on seal body 60 at the interface of surfaces 61, 52 urge seal body 60 to rotate with cone 14, while frictional forces 74 acting on seal body 60 at the interface of surfaces 62, 42 seek to resist rotation of seal body 60.

Without being limited by theory, in general, the magnitude of frictional forces 73, 74 depend on (a) the magnitude of the reactive forces acting in the radial direction (i.e., substantially normal to the interfacing surfaces), and (b) the coefficient of friction at the interface. It should be understood that the coefficient of friction at the interface is at least partially dependent upon the material composition of the interfacing surfaces and the textures of the interfacing surfaces (e.g., the coefficient of friction at the interface of bearing surface 42 and inner sealing surface 62 depends on the material composition of bearing surface 42 and inner sealing surface 62 and the textures of bearing surface 42 and inner sealing surface 62).

Since frictional forces 73, 74 act at a radial distance from axis 90 of journal shaft 18 (FIG. 2), they may also be described herein as torques $T_1$, $T_2$, respectively. Specifically, torque $T_1$ acts on seal body 60 at the interface of surfaces 61, 52 and tends to urge seal body 60 to rotate with cone 14. However, torque $T_2$ acts on seal body 60 at the interface of surfaces 62, 42 and tends to resist rotation of seal body 60. Thus, torques $T_1$, $T_2$, act on seal body 60 in generally opposite directions. Without being limited by theory, if torque $T_1$ acting on outer sealing surface 61 is greater than torque $T_2$, acting on inner sealing surface 62, then seal body 60 will tend to rotate with cone 14 relative to journal shaft 18. However, if torque $T_1$, acting on inner sealing surface 62 are greater than torque $T_2$ acting on outer sealing surface 61, then seal body 60 will tend to remain static relative to journal shaft 18 as cone 14 rotates.

In the embodiments described herein, torque $T_2$ is preferably maintained to be greater than torque $T_1$, and thus, outer seal 63 may be referred to as dynamic seal 63 and inner seal 64 may be referred to as static seal 64. Likewise, in such cases, outer sealing surface 61 may be referred to as dynamic sealing surface 61 and inner sealing surface 62 may be referred to as static sealing surface 62.

As previously described, reactive forces 71, 72 give rise to torques $T_1$, $T_2$ acting on seal body 60. Reactive forces 71 result substantially from the compression of seal body 60 within seal gland 51. However, reactive forces 72 result from the compression of seal body 60 within seal gland 51 as well as the interference fit between seal body 60 and journal shaft 18. Thus, by design, reactive forces 72 are greater than reactive forces 71, thereby enabling torque $T_2$ acting on seal body 60 at inner sealing surface 62 to be greater than torque $T_1$ acting on seal body 60 at outer sealing surface 63, even after taking account for differences in the radial distances at which torques $T_1$, $T_2$ act. Thus, in the embodiments described above, static engagement between inner sealing surface 62 and bearing surface 42 is maintained, at least in part, by an interference fit between seal body 60 and journal shaft 18.

It should be appreciated that by varying the inner diameter $D_1$ and the outer diameter $D_2$ Of seal body 60, reactive forces 71, 72 and torques $T_1$, $T_2$ may be adjusted and controlled as desired. For instance, in an exemplary embodiment, the radial difference $(D_3-D_1)/2$ between journal shaft 18 and seal body 60, when seal body 60 is in its undeformed state, preferably ranges from 0.010 inch to 0.060 inch, and more preferably ranges from 0.020 inch to 0.050 inch. Further, in the exemplary embodiment, the radial difference $(D_4-D_2)/2$ between sealing surface 52 and seal body 60, when seal body 60 is in its undeformed state, preferably ranges from 0.005 inch to 0.030 inch, and more preferably ranges from 0.010 inch to 0.02 inch.

Referring briefly to FIGS. 3 and 6C, seal sidewalls 65 of seal body 60 preferably do not engage, or minimally engage, annular surfaces 53 of recess 34, even when seal body 60 is compressed within seal gland 51. Thus, one or two gaps G are preferably maintained between seal sidewalls 65 and annular surfaces 53. It should be appreciated that engagement between seal sidewalls 65 and annular surfaces 53 will result in reactive forces that give rise to frictional forces and torques tending to urge seal body 60 remain static relative to cone 14. If engagement between seal sidewalls 65 and annular surfaces 53 is sufficient, the reactive forces and frictional forces therebetween may result in torques sufficient to undesirably overcome torques 74 acting between seal body 60 and journal shaft bearing surface 42, thereby causing seal body 60 to rotate with cone 14 relative to journal shaft 18. Thus, seal body 60 and seal gland 51 are preferably sized and configured such at least one or both seal sidewalls 65 of seal body 60 do not engage, or minimally engage, annular surfaces 53 of recess 34 when seal body 60 is compressed within seal gland 51. Thus, width $W_1$ of seal body 60 is preferably less than width $W_2$ of recess 34 when seal body 60 is in its undeformed state prior to assembly (FIG. 4) and further, width $W_1$ of seal body 60 is preferably less than width $W_2$ of recess 34 after assembly when seal body 60 is deformed and compressed within seal gland 51.

Figure 8A:
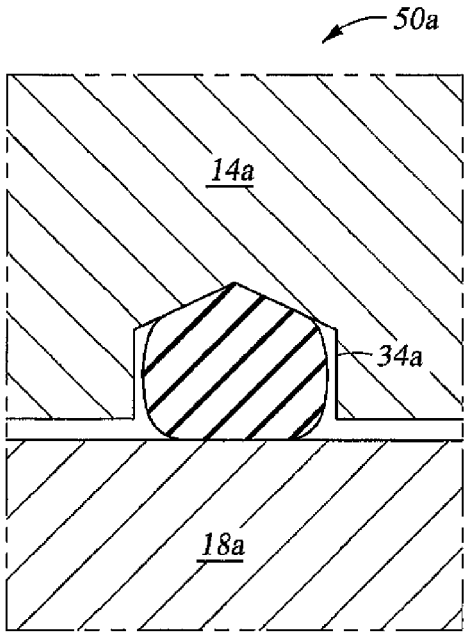
FIGS. 8A to 8D are enlarged cross-sectional view of alternative embodiments of the seal assembly of FIG. 2.

Although seal body 60 and recess 34 are each shown as having a rectangular cross-section, it should be appreciated that seal body 60 and/or recess 34 may have other suitable cross-sectional shapes, such as circular, oval, triangular, or trapezoidal, as examples. In FIGS. 8A-8D, four exemplary seal assemblies including alternative cross-sectional shapes for the seal body and the recess are illustrated. Each embodiment shown in FIGS. 8A-8D operates substantially the same as seal assembly 50 illustrated in FIG. 3. Referring to FIG. 8A, seal assembly 50*a* seals between a journal shaft 18*a* and a rotating cone 14*a* and includes a seal body 60*a* disposed in a recess 34*a*. In this embodiment, seal body 60*a* has a substantially circular cross-section in its relaxed state prior to assembly and recess 34*a* has a hexagonal cross-sectional shape. When compressed between bearing surface 42*a* and sealing surface 52*a*, seal body 60*a* slightly deforms with its radially outer and radially inner surfaces deforming to mate with and sealingly engage sealing surface 52*a* and bearing surface 42*a*, respectively.

Figure 8B:
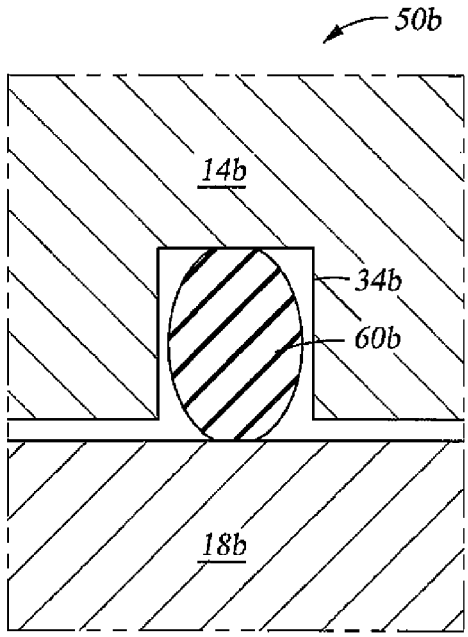

Referring to FIG. 8B, seal assembly 50*b* seals between a journal shaft 18*b* and a rotating cone 14*b* and includes a seal body 60*b* disposed in a recess 34*b*. In this embodiment, seal body 60*b* has a substantially oval cross-section in its relaxed state prior to assembly and recess 34*b* has a rectangular cross-section. When compressed between bearing surface 42*b* and sealing surface 52*b*, seal body 60*b* slightly deforms with its radially outer and radially inner surfaces deforming to mate with and sealingly engage sealing surface 52*b* and bearing surface 42*b*, respectively.

Figure 8C:
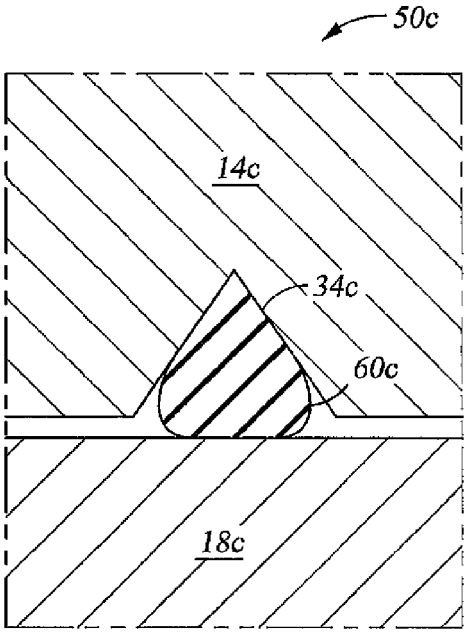

Referring to FIG. 8C, seal assembly 50*c* seals between a journal shaft 18*c* and a rotating cone 14*c* and includes a seal body 60*c* disposed in a recess 34*c*. In this embodiment, seal body 60*c* has a substantially tear drop cross-section in its relaxed state and recess 34*c* has a triangular cross-sectional shape. When compressed between bearing surface 42*c* and sealing surface 52*c*, seal body 60*c* slightly deforms with its radially outer and radially inner surfaces deforming to mate with and sealingly engage surfaces 52*c* and bearing surface 42*c*, respectively.

Figure 8D:
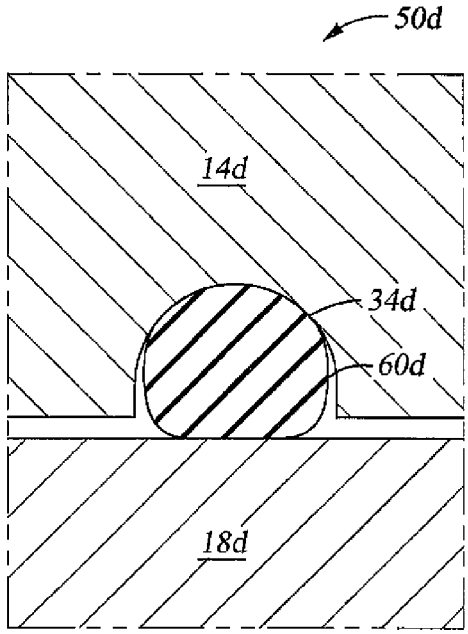

Lastly, referring to FIG. 8D, seal assembly 50*d* seals between a journal shaft 18*d* and a rotating cone 14*d* and includes a seal body 60*d* disposed in a recess 34*d*. In this embodiment, seal body 60*d* has a substantially rectangular cross-section in its relaxed state and recess 34*d* has a semi-circular cross-sectional shape. When compressed between bearing surface 42*d* and sealing surface 52*d*, seal body 60*d* slightly deforms with its radially outer and radially inner surfaces deforming to mate with and sealingly engage surface 52*d* and bearing surface 42*d*, respectively.

In each embodiment illustrated in FIGS. 8A-8C, at least one gap G is provided between at least a portion of a sidewall of the seal body and the adjacent surface of the annular recess. In some embodiments (e.g., FIGS. 8A and 8B), neither sidewall of the seal body engages the recess surface. Depending on the shape and geometry of the seal body and the recess, the shape and geometry of one or more gaps G between the seal body and the recess may vary.

Seal body 60 preferably comprises an elastomeric material such as fluoroelastomers including those available under the trade name Advanta manufactured by DuPont, carboxylated elastomers such as carboxylated nitrites, highly saturated nitrile (HISN) elastomers, nitrile-butadiene rubber (HBR), highly saturated nitrile-butadiene rubber (HNBR) and the like. It is to be understood that the HNBR material set forth in the example, and the HSN materials described above, are only examples of elastomeric materials useful for making an embodiment of annular seal body (e.g., seal body 60) according to the present invention, and that other elastomeric materials made from different chemical compounds and/or different amounts of such chemical compounds may also be used.

Suitable elastomeric materials have a modulus of elasticity at 100 percent elongation of from about 500 to 2,000 psi (~3 to 14 MPa), a minimum tensile strength of from about 1,000 to 7,000 psi (~6 to 50 MPa), elongation of from 100 to 500 percent, die C tear strength of at least 100 lb/in. (1.8 kilogram/millimeter), durometer hardness Shore A in the range of from about 60 to 95, and a compression set after 70 hours at 100° C. of less than about 18 percent, and preferably less than about 16 percent. A preferred elastomeric material is a proprietary HSN manufactured by Smith International, Inc., under the product name HSN-8A. A material having these properties will provide the desired degree of wear resistance, abrasion resistance, friction resistance, and temperature stability to provide sufficient seal performance at seals 63, 64 under operating condition. In addition, materials with these or similar properties will provide seal body 60 with a desired degree of deflection so as to provide enhanced sealing under extreme operating conditions.

In addition, to maintain the desired properties of seal body 60 at the pressure and temperature conditions that prevail in a rock bit, to inhibit leakage of the lubricating grease across seal assembly 50, and for a long useful life, seal body 60 preferably comprises a material or coating that is resistant to crude oil and other chemical compositions found within oil wells, have a high heat and abrasion resistance, have low rubbing friction, and not be readily deformed under the pressure and temperature conditions in a well which could allow leakage of the grease from within bit 10 or drilling mud into bit 10.

As previously described, most conventional seal assemblies in rolling cone bits for preventing leakage of lubricant and entrance of drilling fluid include an O-ring type seal that is intended to dynamically seal with the journal shaft of the bit and statically seal with the rolling cone that rotates about the journal shaft. In contrast to most conventional seal assemblies, embodiments of seal assembly 50 described herein include a seal body 60 having a dynamic sealing surface 61 at its outer diameter $D_1$ that forms a dynamic seal 63 with cone 14, and a static sealing surface 62 at its inner diameter $D_2$ that forms static seal 64 with journal shaft 18. Orientation of dynamic sealing surface 61 at the outer diameter $D_1$ of seal body 60 and static sealing surface 61 at the inner diameter $D_2$ of seal body 60 offers the potential for several benefits over conventional rolling cone drill bit seals as are described in the paragraphs to follow.

As previously described, since dynamic sealing surfaces and dynamic seals typically encounter increased abrasion, wear, and temperature conditions as compared to static sealing surfaces and static seals, dynamic sealing surfaces and dynamic seals are generally more susceptible to premature breakdown and failure than static sealing surfaces and static seals. Referring to FIG. 3, by positioning dynamic sealing surface 61, and hence dynamic seal 63, at the outer diameter $D_2$ of seal body 60 within recess 34, embodiments illustrated herein provide enhanced protection for dynamic seal 63 and dynamic sealing surface 61. For example, in most conventional rolling cone drill bit seals in which the dynamic seal is formed at the inner diameter of the seal (i.e., between the seal and the journal shaft), the cutting-laden drilling fluid has a relatively unobstructed and direct path to the dynamic seal through the clearance or groove between the rolling cone and journal shaft. However, by positioning dynamic seal 64 within recess 34 in the embodiments described herein, cutting-laden drilling fluid 91 must flow through a more tortuous or circuitous path in order to reach dynamic sealing surface 61 and dynamic seal 63. Not only must drilling fluid 91 flow through the passageway between bearing surfaces 30, 42, but it must also flow around corner 58 and flow through the narrow passage between sidewall 53 of seal body 60 before reaching dynamic sealing surface 61 and dynamic seal 63. This more tortuous or circuitous path advantageously provides additional resistance to the flow of drilling fluid 91, which offers the potential to increase the life of dynamic seal 63 and seal body 60.

Referring still to FIG. 3, by positioning the dynamic seal 63, and hence the dynamic sealing surface 61, at the outer diameter $D_2$ of seal body 60 within recess 34, embodiments described herein also offer the potential to reduce and/or eliminate extrusion and nibbling of seal body 60. Specifically, since dynamic seal 63 is positioned within recess 34, dynamic sealing surface 61 is distal the clearance or groove between cone bearing surface 30 and journal bearing surface 42. There are no grooves or passageways proximal dynamic seal 63, and further, any axial movement of dynamic sealing surface 61 within recess 34 is bounded by annular surfaces 53. Thus, even if a pressure differential across dynamic seal 63 exists, extrusion and potential nibbling of dynamic sealing surface 61 is substantially reduced and/or eliminated. As previously described, in many conventional rolling cone drill bit seals, the dynamic sealing surface of the seal engages the journal shaft adjacent the clearance or groove between the rotating cone and journal shaft. Thus, pressure differentials across the seal may urge the those portions of the seal proximal the dynamic sealing surface into this passageway. Such extruded portions of the seal may then become pinched between the rotating cone and the relatively static journal shaft, potentially resulting in nibbling and damage to such portions of the seal.

Referring still to FIG. 3, by positioning dynamic sealing surface 61 at the outer diameter $D_2$ of seal body 60, embodiments described herein also offer the potential to desirably increase lubrication of dynamic seal 63 and hence the useful life of seal body 60 and seal assembly 50. Specifically, as cone 14 rotates about journal shaft 18, frictional effects (e.g., skin friction) between lubricant 95 and the surfaces of cone 14 (e.g., bearing surface 30, annular surface 53, sealing surface 52, etc.) will cause portions of lubricant 95 adjacent the surfaces of cone 14 to rotate along with cone 14. It being understood that the tangential velocity due to rotational motion is greater at greater radial distances, lubricant 95 will have its greatest tangential velocity adjacent sealing surface 52 proximal corner 57 and dynamic seal 63 (against the surface of cone 14 having the greatest radius within recess 34). Further, since the velocity and pressure of a fluid are inversely related, lubricant 95 will have its lowest pressure at sealing surface 52 proximal corner 57 and dynamic seal 63 (i.e., lubricant 95 will have lower pressure at locations where lubricant 95 has higher tangential velocity). Consequently, lubricant 95 will tend to flow towards this lower pressure region adjacent corner 57 and dynamic seal 63, thereby offering the potential for enhanced lubrication and lifetime for dynamic seal 63 and dynamic sealing surface 61.

Likewise, within recess 34, drilling fluid 91 will also have its highest tangential velocity and lowest pressure adjacent sealing surface 52 proximal corner 57 and dynamic seal 63. Thus, drilling fluid 91 may have a tendency to flow towards this relatively lower pressure region within recess 34. However, the pressure of lubricant 95 within drill bit 10 is controlled by pressure compensation subassembly 29 (FIG. 2) and generally maintained at a higher pressure than drilling fluid 91, thereby tending to minimize and/or prevent drilling fluid 91 from flowing across dynamic seal 63.

To the contrary, in most conventional rolling cone drill bit seals, the dynamic seal is located at the inner diameter of the seal body against the journal shaft, and the static seal are located at the outer diameter of the seal body against the rolling cone. Since the dynamic seal is located at lesser radial distance than the static seal, the lubricant will tend to flow to the lower pressure region adjacent the static seal and away from the region where it is needed most, adjacent the dynamic seal.

Although embodiments of seal body 60 previously described comprised a single material, preferably an elastomeric material, it should be appreciated that a single seal body may comprise two or more different materials having different hardnesses, wear resistances, durabilities, etc. Such a seal body comprising more than one material may be referred to herein as a "multi-part seal body" or a "composite seal body."

As previously described, different portions of a seal body (e.g., seal body 60) experience different operating conditions. For instance, the dynamic sealing surfaces of a seal body are generally subjected to harsher operating conditions that other regions of the seal body. In particular, dynamic sealing surfaces are subjected to a higher degree of wear and heat from rotation against cone surfaces or journal surfaces. Additionally, dynamic sealing surfaces are subjected to a highly abrasive environment of drilling fluid and hostile chemicals. For at least these reasons, a seal body formed from a single type of material may not necessarily be perfectly suited to meet the operating conditions at the different regions of the seal body (e.g., the dynamic sealing surface, the static sealing surface, etc.) Although simpler and less expensive to manufacture, a seal body made of a single type of material may represent a compromise between meeting the operating conditions at different portions of the seal. Such a compromise may result in premature failure of the seal body. However, the use of a multi-part seal body enables the customization of the material composition and material properties at different regions of the seal body, thereby offering the potential for a seal body with improved operational capabilities and an enhanced operational life.

Figure 9A:
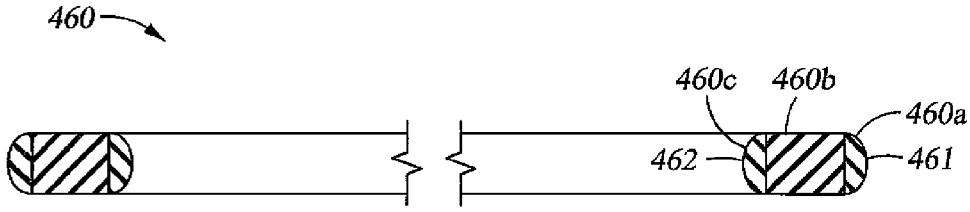
FIG. 9A is an enlarged cross-sectional view of another embodiment of the seal assembly of FIG. 2 including a multi-part seal body.
Figure 9B:
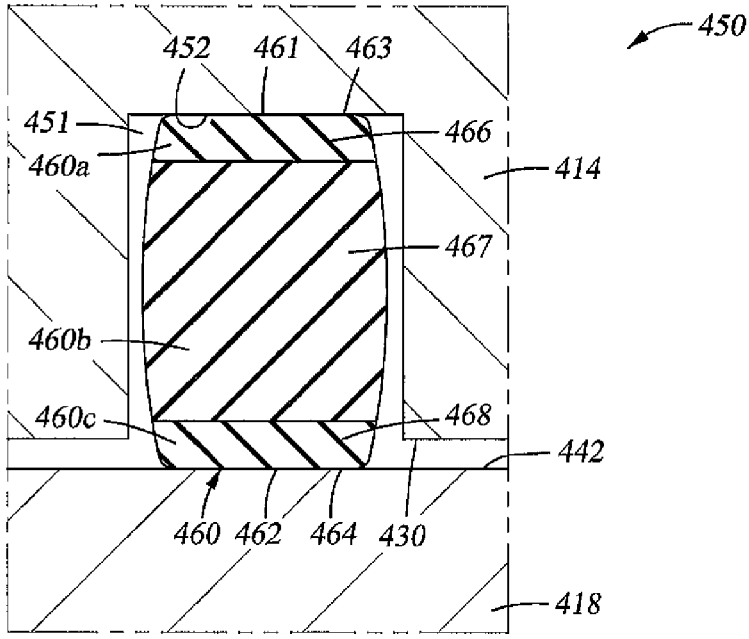
FIG. 9B is a cross-sectional view of the multi-part seal body of FIG. 9A.

Referring now to FIGS. 9A and 9B, a seal assembly 450 including a multi-part seal body 460 is illustrated. Seal assembly 450 operates substantially the same as seal assembly 50 previously described with the exception that seal assembly 450 includes a multi-part seal body 460 to seal between journal shaft 418 and cone 414.

In this embodiment, multi-part seal body 460 includes an outer radial portion 460*a* made of a first material 466, a middle portion 460*b* made of a second material 467, and an inner radial portion 460*c* made of a third martial 468. During use, outer sealing surface 461 of outer radial portion 460*a* is intended to engage sealing surface 452 and form an outer dynamic seal 463 therebetween. Similarly, inner sealing surface 462 of inner radial portion 460*c* is intended to engage journal shaft bearing surface 442 and form an inner static seal 464 therebetween.

The composition of first material 466, second material 467, and third material 468 may be selected as desired. Any two or more of first material 466, second material 467, or third material 468 may comprise the same or different materials.

Outer sealing surface 461 forms outer dynamic seal 463, and thus, first material 466 preferably comprises a relatively harder, more wear resistant material having a relatively low coefficient of friction and capable of operating at relatively higher temperatures. In addition, inner sealing surface 462 forms inner static seal 464, and thus, third material 468 may comprise a material that is softer, i.e., lower durometer hardness, having a higher coefficient of friction than first material 466. However, since inner sealing surface 462 may rotate relative to journal shaft bearing surface 442 on occasion, third material 468 preferably comprises a relatively harder, more wear resistant material having a relatively low coefficient of friction and capable of operating at relatively higher temperatures. Middle portion 460*b* preferably biases outer sealing surface 461 towards sealing surface 463 and biases inner sealing surface 462 towards journal shaft bearing surface 442. Thus, second material 467 preferably comprises a relatively softer, i.e., low durometer hardness, rubber or elastomeric material capable of serving as an energizer that urges dynamic sealing surface 461 towards sealing surface 452 and urges static sealing surface 462 towards journal shaft bearing surface 442, thereby producing a sufficient amount of contact pressure between surfaces 461, 452 and between surfaces 462, 442.

First material 466 forming outer radial portion 460*a* and dynamic sealing surface 461 preferably comprises a wear resistant rubber or elastomeric material having a durometer Shore A hardness measurement in the range of from about 75 to 95, and more preferably greater than about 80, a modulus of elasticity at 100 percent elongation of in the range of from about 700 to 2,000 psi, (~4 to 14 MPa) elongation of from about 100 to 400 percent, a tensile strength of in the range of from about 1,500 and 4,000 psi (~10 to 28 MPa), and a compression set after 70 hours at 100° C. in the range of from about 8 to 18 percent. A material having these properties will provide the desired degree of wear resistance, abrasion resistance, friction resistance, and temperature stability to provide enhanced seal performance at the dynamic seal surface under operating conditions, thereby extending the service life of the rock bit.

Harder rubber or elastomeric materials are preferred to form the dynamic sealing surface (e.g., dynamic sealing surface 461) because they are also more stable under high temperature conditions, generally have a lower coefficient of friction, and minimizes stick slip, thereby resulting in less wear and less heat generation at the dynamic surface of the seal.

Other suitable materials useful for forming outer radial portion 460*a* and dynamic sealing surface 461 include so called self-lubricating rubber or elastomeric compounds that include one or more lubricant additive(s) to provide enhanced properties of wear and friction resistance along the surface of the dynamic seal. Suitable lubricant additives include, without limitation, polytetrafluoroethylene (PTFE), graphite flake, hexagonal boron nitride (hBN), molybdenum disulfide ($MoS_2$), and other known fluoropolymeric, dry, or polymeric lubricants and mixtures thereof. The lubricant additive is used to provide an added degree of low friction and wear resistance to the elastomeric component of the composite material that is placed in contact with a rotating surface. A preferred lubricant additive is hBN manufactured by Advanced Ceramics identified as Grade HCP, having an average particle size in the range of from about five to ten micrometers. hBN is a preferred lubricant additive because it provides a superior degree of lubrication when placed in contact with steel without producing harmful, e.g., abrasive, side effects to the journal or cone.

A particularly preferred HSN elastomer (HSN-8A) useful for forming the dynamic seal surface has a durometer Shore A hardness measurement in the range of from about 77-84, a modulus of elasticity at 100 percent elongation of in the range of from about 800 to 1300 psi (~5,500 to 8,700 kPa), elongation in the range of from about 150 to 400 percent, a tensile strength in the range of from about 1,000 to 4,500 psi (~7,000 to 31,000 kPa), and a compression set after 70 hours at 100° C. of less than about 18 percent.

Since static sealing surface 462 may occasionally rotate relative to journal shaft bearing surface 442, third material 468 forming inner radial portion 460*c* and static sealing surface 462 also preferably comprise a wear resistant rubber or elastomeric material similar to those disclosed above with reference to first material 466.

Second material 467 forming middle portion 460*b* preferably comprises a rubber or elastomeric material such as nitrile and HSN elastomers that have a durometer Shore A hardness measurement in the range of from about 60 to 80, and preferably less than about 75, a modulus of elasticity at 100 percent elongation of between about 400 to 750 psi (~2,700 to 5,000 kPa), elongation of from about 200 to 1,000 percent, a minimum tensile strength of from about 1,000 to 4,000 psi (~7,000 to 28,000 kPa), and a compression set after 70 hours at 100° C. the range of from about 5 to 18 percent. A material having such properties forms a seal surface that provides a desired degree of deflection and biasing action to provide enhanced seal performance at static sealing surface 462 and dynamic sealing surface 461 under operating conditions, thereby extending the service life of the rock bit.

A preferred rubber or elastomeric material for use in forming middle portion 460*b* is HSN that has a durometer Shore A hardness measurement in the range of from about 73 to 78, a modulus of elasticity at 100 percent elongation of between about 500 to 600 psi (~3,500 to 4,200 kPa), elongation of from about 300 to 400 percent, a minimum tensile strength of approximately 4,000 psi (~27,000 kPa), and a compression set after 70 hours at 100° C. of approximately 14 percent.

Although multi-part seal body 460 illustrated in FIGS. 9A and 9B includes three different materials (i.e., first material 466, second material 467, and third material 468), in general, a multi-part seal body employed in embodiments of the present invention may comprise one, two, three, or more materials as desired.

In the embodiments described herein that include a seal body comprising two or more materials, the materials may be coupled by any suitable method to form a unitary seal body. Examples of suitable methods include, without limitation, bonding the materials together by an adhesive or chemical bond, molding or melting the materials together, or combinations thereof.

As an alternative to, or in addition to, wear resistant rubber or elastomeric materials, in some embodiments, one or more surfaces of the seal body (e.g., seal body 60) may comprise a non-elastomeric wear resistant and/or temperature resistant layer. Such layers may be especially beneficial for use on dynamic sealing surfaces that typically experience greater wear, abrasion, and temperatures than other regions of the seal body.

Figure 10:
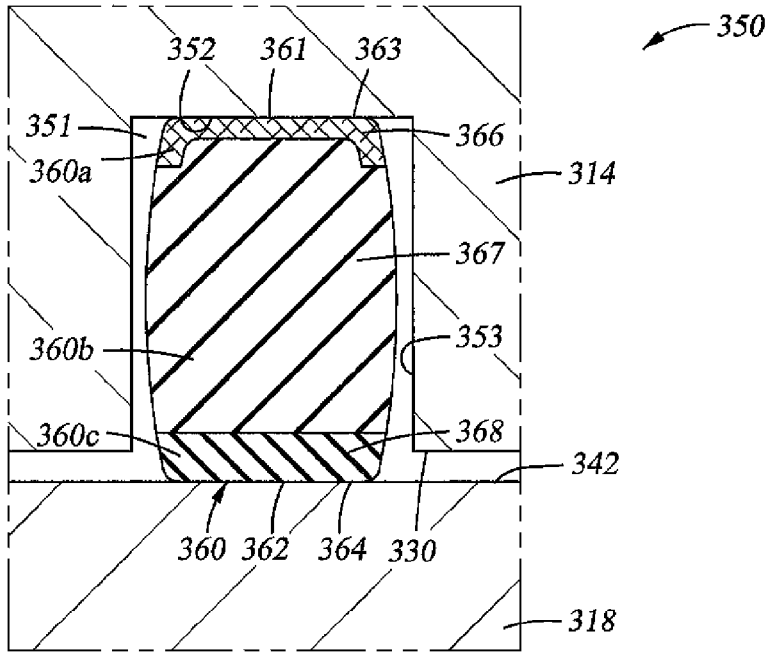
FIG. 10 is an enlarged cross-sectional view of another embodiment of the seal assembly of FIG. 2 including a multi-part seal body.

Referring now to FIG. 10, a seal assembly 350 including a multi-part seal body 360 is illustrated. Seal assembly 350 operates substantially the same as seal assembly 50 previously described with the exception that seal assembly 350 includes a multi-part seal body 360 to seal between journal shaft 318 and cone 314.

As with seal body 460 previously described (FIGS. 9A and 9B), multi-part seal body 360 includes an outer radial portion 360*a* made of a first material 366, middle portion 360*b* made of a second material 367, and an inner radial portion 360*c* made of a third martial 368. Second material 367 and third material 368 preferably comprise rubber or elastomeric materials similar to those described above with reference to second material 467 and third material 468, respectively (FIGS. 9A and 9B). However, contrary to first material 466 in FIGS. 9A and 9B, first material 366 forming outer radial portion 360*a* and outer dynamic sealing surface 361 preferably comprises a non-elastomeric wear resistant material. In particular, in the embodiment illustrated in FIG. 10, first material 366 comprises a relatively thin layer of wear resistant non-elastomeric material.

Non-elastomeric materials suitable for first material 366 forming dynamic sealing surface 461 are preferably in the form of fibers known to have good properties of wear resistance and/or temperature resistance. Example polymeric materials include polyester fiber, cotton fiber, aromatic polyamides (Aramids) such as those sold under the trade name Kevlar by E.I. DuPont de Nemours and Co. of Wilmington, Del., polybenzimidazole (PBI) fiber, poly m-phenylene isophthalamide fiber such as those sold under the trade name Nomex by E.I. DuPont de Nemours and Co. of Wilmington, Del., asbestos fiber, and mixtures or blends thereof. The fibers can be: (1) used in their independent state, e.g., as a random arrangement of fibers distributed within an elastomeric constituent of the seal; (2) combined in a random or unordered an-angement to form a felt sheet; (3) combined in an ordered or non-random arrangement to form a sheet; or (4) combined into threads and woven into a fabric to form a fabric sheet. When fabricated into sheet form, the fibers can be arranged to provide a desired tensile strength in one or more desired direction to meet particular application demands. Additionally, the same or differently oriented fabric sheets can be stacked upon one another to meet certain performance characteristics, e.g., the sheets can be ordered and stacked to provide properties of improved wear resistance in a particular direction.

Preferred non-elastomeric polymeric materials suitable for first material 366 forming dynamic sealing surface 461 include those having a softening point higher than about 350° F., and having a tensile strength of greater than about 10,000 psi (~68 MPa). Other non-elastomeric materials suitable for use in forming one or more portion of a seal body include those that display properties of high-temperature stability and endurance, wear resistance, and have a coefficient of friction similar to those polymeric materials specifically mentioned above.

Although non-elastomeric wear resistant and temperature resistant layers may be particularly beneficial to dynamic sealing surfaces, it should be appreciated that such wear resistant materials may also provide benefits at static sealing surfaces that may rotate on occasion or may rotate upon failure.

In the embodiments described above, the static engagement between the inner sealing surface (e.g., inner sealing surface 62) of the seal body (e.g., seal body 60) and the journal shaft bearing surface (e.g., bearing surface 42) is maintained, at least in part, by an interference fit between the seal body and the journal shaft. However, other methods may also be employed to enhance the likelihood of static engagement between the inner sealing surface and the journal shaft bearing surface and dynamic engagement between the outer sealing surface and the sealing surface (e.g., sealing surface 52) of the recess (e.g., recess 34).

Figure 11:
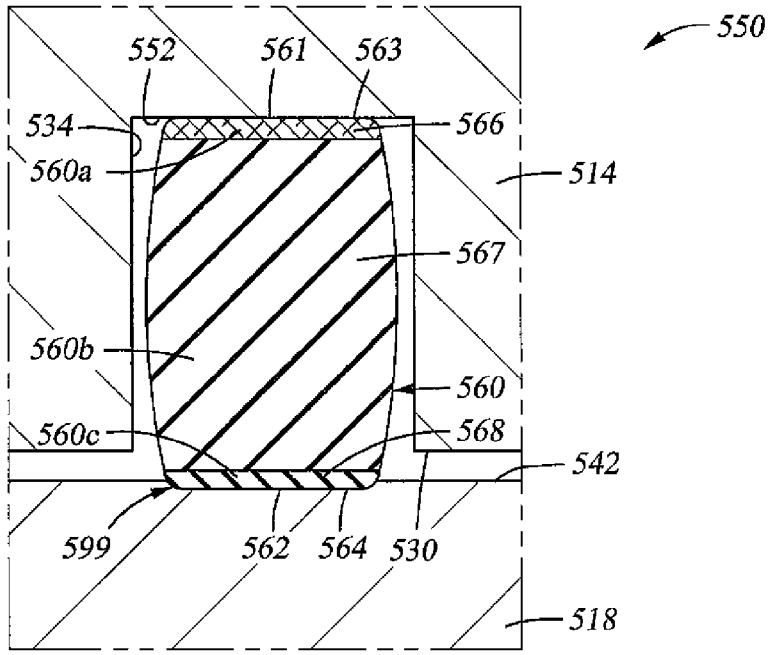
FIG. 11 is an enlarged cross-sectional view of another embodiment of the seal assembly of FIG. 2 including a bond between the seal body and the journal shaft.

Referring to FIG. 11, a seal assembly 550 including a multi-part seal body 560 is illustrated. Seal body 560 includes an outer dynamic sealing surface 561 that forms a dynamic seal 563 with sealing surface 552 of recess 534 and an inner static sealing surface 562 that forms a static seal 564 with journal shaft bearing surface 542. It should be appreciated that seal body 560 comprises a radially outer portion 560*a* made of a first material 566 and a radially inner portion 560*b* made of a second material 567. First material 566 preferably comprises a wear resistant elastomeric material or a wear resistant non-elastomeric material as previously described.

Seal assembly 550 operates substantially the same as seal assembly 50 previously described. However, in this embodiment, seal body 560 is maintained static relative to journal shaft 518 via a bond 599. Specifically, bond 599 fixes inner sealing surface 562 of seal body 560 with bearing surface 542 of journal shaft 518. Consequently, a static seal 464 is formed at the interface of inner sealing surface 562 and bearing surface 542, and a dynamic seal 563 is formed at the interface of outer sealing surface 561 and sealing surface 552 of recess 543. Thus, bond 599 may be used to maintain a static seal 464 between the inner sealing surface 562 of seal body 560 and bearing surface 542 of journal shaft. It should be understood that bond 599 may be used as an alternative to an interference fit between seal body 560 and journal shaft 518, or in addition to an interference fit between seal body 560 and journal shaft 518.

Bond 599 may be formed by any suitable method. For instance, a bonding agent may be employed to form bond 599 between surfaces 562, 542. The bonding agent may be applied to bearing surface 542 opposite recess 534 prior to assembly. Alternatively, the bonding agent may be applied to inner sealing surface 562 or provided as an additive in seal body 560 at inner sealing surface 562 prior to assembly. Following assembly, the bonding agent may be activated to form a fixed bond 599 between surfaces 562, 564. For instance, the bonding agent may be heat and/or pressure activated such that following assembly of seal assembly 550, the application of heat and/or pressure to the bonding agent causes the bonding agent to form a fixed connection or bond between surfaces 562, 542.

In general, the bonding agent employed to form bond 599 is preferably suitable for bonding the materials employed at inner sealing surface 562 and bearing surface 542. In embodiments where inner sealing surface 562 comprises an elastomer and journal shaft 518 comprises a metal or metal alloy, the bonding agent preferably comprises a phenolic resin (e.g., novolac type, resol types, etc.), a phenolic resin/chlorinated polymer combination, silanes, or the like. In some embodiments, additional ingredients or slurries may be added to the bonding agent to enhance the mechanical strength of the bond.

Figure 12:
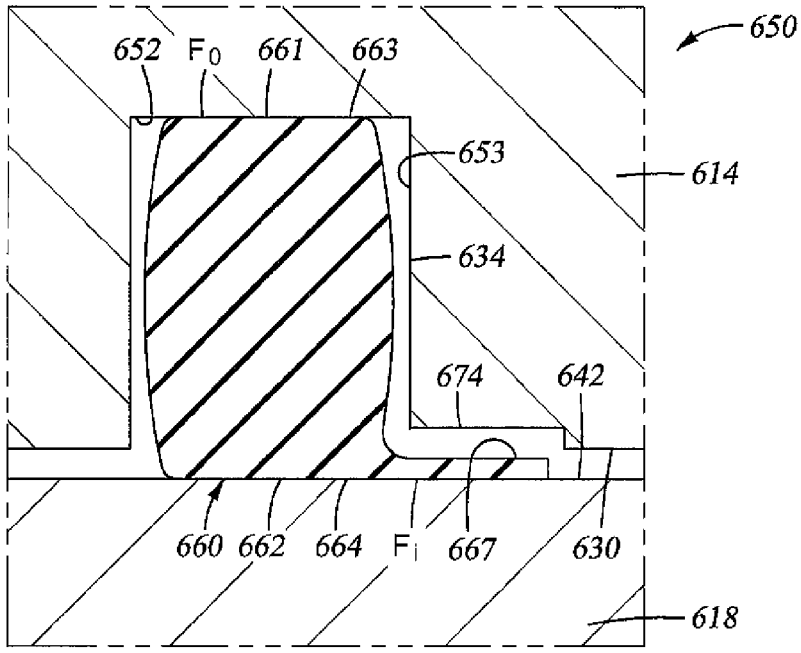
FIG. 12 is an enlarged cross-sectional view of another embodiment of the seal assembly of FIG. 2 including a seal body having an axially extending flange.

Referring now to FIG. 12, a seal assembly 650 including a seal body 660 is illustrated. Seal assembly 650 operates substantially the same as seal assembly 50 previously described. However, in this embodiment, seal body 660 includes a flange 667 that extends axially from the radially innermost portion of seal body 660, thereby increasing the surface area of inner sealing surface 662 of seal body 660 that engages bearing surface 642. Flange 665 extends axially beyond annular surface 653 and recess 634.

Referring still to FIG. 12, inner sealing surface 662 and inner static seal 664 have a sealing surface area or footprint $F_i$. Likewise, outer sealing surface 661 and outer dynamic seal 662 have a sealing surface area or footprint $F_o$. Inclusion of flange 667 increases footprint $F_i$ such that footprint $F_i$ is greater than footprint $F_o$.

By increasing the contact surface area and footprint $F_i$ between inner sealing surface 662 and bearing surface 642, flange 667 offers the potential to increase frictional forces acting at the interface of surfaces 662, 642. Consequently, flange 667 may provide an additional, or alternative means, to maintain inner sealing surface 662 of seal body 660 static relative to bearing surface 642. Since axially extending flange 667 increases the surface area of inner sealing surface 662 of seal body 660, flange 667 may be described as increasing the "footprint" of inner sealing surface 662.

In this embodiment, space to accommodate flange 667 is provided by an annular recess 674 adjacent recess 634. Without sufficient space to accommodate flange 667, nibbling of flange 667 between the rotating cone bearing surface 630 and the static journal shaft bearing surface 642 may occur.

Figure 13:
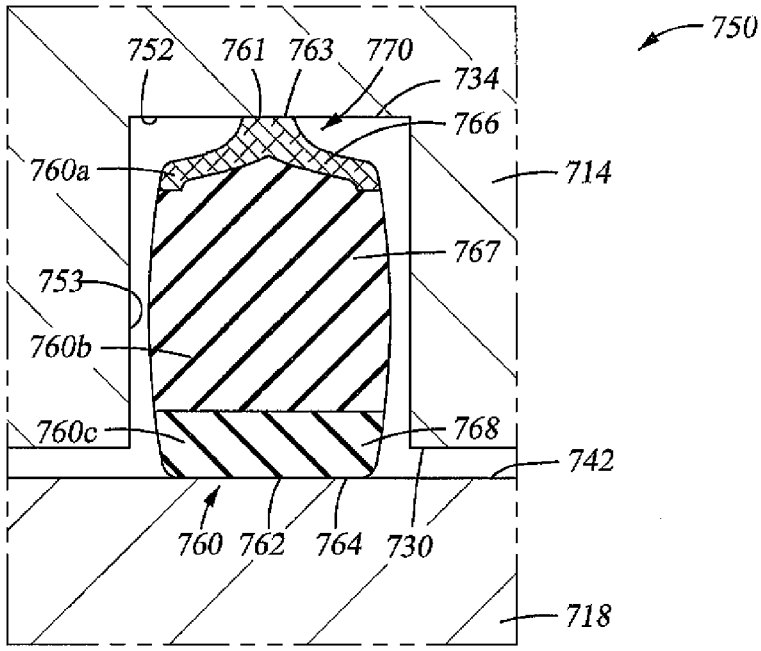
FIG. 13 is an enlarged cross-sectional view of another embodiment of the seal assembly of FIG. 2 including a seal body having a radially extending peak.

Referring now to FIG. 13, a seal assembly 750 including a multi-part seal body 760 is illustrated. Seal assembly 750 operates substantially the same as seal assembly 350 previously described. However, in this embodiment, outer sealing surface 761 of seal body 760 includes a radially extending annular peak or ridge 770 that engages sealing surface 752. Peak 770 preferably sealingly engages sealing surface 752 to form a dynamic seal 763. However, in different embodiments, peak 770 may contact surface 752 but not form a seal with surface 752.

In addition, in the embodiment illustrated in FIG. 13, multi-part seal body 760 comprises a radially outer layer or portion 760*a* made from a first material 766, a middle portion 760*b* made from a second material 767, and a radially inner portion 760*c* made from a third material 768. First material 766 preferably comprises a wear resistant non-elastomeric material as previously described, third material 768 preferably comprises a relatively hard wear resistant rubber or elastomeric material as previously described, and second material 767 preferably comprises a relatively softer rubber or elastomeric material capable of serving as an energizer as previously described.

By engaging sealing surface 752 of recess 734 with peak 770, a reduced portion of radially outer portion 760*a* of seal body 760 contacts sealing surface 752 as compared to the embodiment illustrated in FIGS. 9A and 9B. By reducing the contact surface area and footprint between radially outer portion 760*a* and sealing surface 752, peak 770 offers the potential to reduce frictional forces acting at the interface of radially outer portion 760*a* and sealing surface 752. Consequently, peak 770 may provide an additional, or alternative means, to maintain outer sealing surface 761 dynamic relative to sealing surface 752. Since peak 770 reduces the surface area of outer sealing surface 761 of seal body 760, peak 770 may be described as decreasing the "footprint" of outer sealing surface 761.

Figure 14:
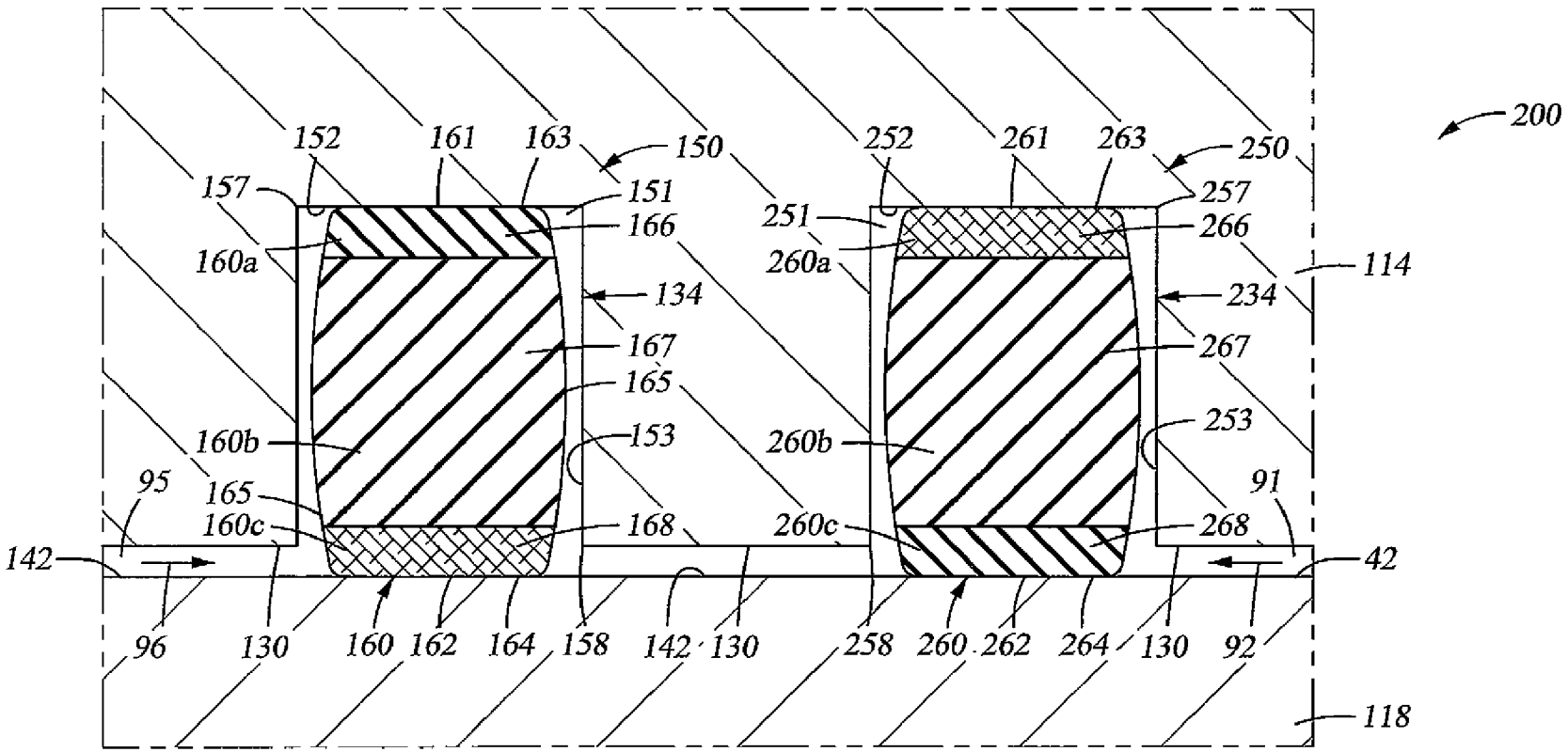
FIG. 14 is an enlarged cross-sectional view of another alternative embodiment of a seal arrangement including the seal assembly of FIG. 3.

Seal bodies including a radially inner static sealing surface that sealingly engages a journal shaft and a radially outer dynamic sealing surface that sealingly engages a cone cutter may be employed in multi-seal arrangements to achieve one or more of the benefits described above. Referring now to FIG. 14, a multi-seal arrangement 200 is illustrated. Multi-seal arrangement 200 is positioned between rolling cone 114 and journal shaft 118 to prevent leakage of lubricant 96 and to prevent entry of cutting-laden drilling fluid 91. Multi-seal arrangement 200 includes a primary seal assembly 150 and a secondary seal assembly 250 that is axially spaced apart from primary seal assembly 250. Specifically, primary seal assembly 150 is closer the inner bearings of the drill bit than secondary seal assembly 250.

Primary seal assembly 150 generally includes a multi-part seal body 160 retained within a seal gland 151, generally comprising an annular recess 134 in cone 114. Recess 134 includes a sealing surface 152 and two annular surfaces 153 extending between cone bearing surface 130 and sealing surface 152. Each annular surface 153 intersects sealing surface 152 to form an annular corner 157. Further, each annular surface 153 intersects bearing surface 130 to form an annular corner 158. Seal gland 151 is further defined by cylindrical bearing surface 142 of journal shaft 118.

Referring still to FIG. 14, seal body 160 includes a radially outer sealing surface 161, a radially inner sealing surface 162 generally opposite radially outer sealing surface 161, and sidewalls 165 extending between radially outer sealing surface 161 and radially inner sealing surface 162. For convenience, radially outer sealing surface 161 and radially inner sealing surface 162 may be referred to as outer sealing surface 161 and inner sealing surface 162, respectively.

Outer sealing surface 161 engages sealing surface 152 of recess 134 to form a radially outer seal 163. Inner sealing surface 162 engages journal shaft bearing surface 142 of journal shaft 118 to form an inner seal 164.

In addition, multi-part seal body 160 includes a radially outer portion 160*a* comprising a first material 166, a middle portion 160*b* comprising a second material 167, and a radially inner portion 160*c* comprising a third material 168. First material 166 and third material 168 preferably comprise wear resistant materials as previously described. In some embodiments, first material 166 and/or third material 168 may comprise a non-elastomeric wear resistant material. Second material 167 preferably comprises an elastomeric material capable of biasing sealing surface 161, 162 towards surfaces 152, 142, respectively.

Likewise, secondary seal assembly 250 generally includes a multi-part seal body 260 retained within a seal gland 251, generally comprising an annular recess 234 in cone 114. Recess 234 includes a sealing surface 252 and two annular surfaces 253 extending between cone bearing surface 130 and sealing surface 252. Each annular surface 253 intersects sealing surface 252 to form an annular corner 257. Further, each annular surface 253 intersects bearing surface 130 to form an annular corner 158. Seal gland 251 is further defined by cylindrical journal shaft bearing surface 142 of journal shaft 118.

Referring still to FIG. 14, seal body 260 includes a radially outer sealing surface 261, a radially inner sealing surface 262 generally opposite radially outer sealing surface 261, and sidewalls 265 extending between radially outer sealing surface 261 and radially inner sealing surface 262. For convenience, radially outer sealing surface 261 and radially inner sealing surface 262 may be referred to as outer sealing surface 261 and inner sealing surface 262, respectively.

Outer sealing surface 261 engages sealing surface 252 of recess 234 to form a radially outer seal 263. Inner sealing surface 262 engages journal shaft bearing surface 242 of journal shaft 118 to form an inner seal 264.

Similar to seal body 160, multi-part seal body 260 includes a radially outer portion 260*a* comprising a first material 266, a middle portion 260*b* comprising a second material 267, and a radially inner portion 260*c* comprising a third material 268. First material 266 and third material 268 preferably comprise wear resistant materials as previously described. In some embodiments, first material 266 and/or third material 268 may comprise a non-elastomeric wear resistant material. Second material 267 preferably comprises an elastomeric material capable of biasing sealing surface 261, 262 towards surfaces 252, 242, respectively.

Seal assembly 200 may be referred to as a multi-seal assembly 200 since it includes more than one seal body (e.g., seal bodies 160, 260).

Cutting-laden, abrasive drilling fluid 91 will tend to enter via the clearance or groove between the drill bit leg and rolling cone backface as previously described with reference to FIG. 2. Drilling fluid 91 may then flow towards multi-seal arrangement 200 generally in the direction of arrows 92 between bearing surfaces 130, 142. Similarly, lubricant 95 within the drill bit flows toward multi-seal arrangement 200 generally in the direction of arrows 96 between bearing surfaces 130, 142. However, primary seal assembly 150 and secondary seal assembly 250 of multi-seal arrangement 200 cooperate to maintain the separation of lubricant 95 and cutting-laden, abrasive drilling fluid 91 by preventing the passage of lubricant 95 and/or cutting-laden, abrasive drilling fluid 91.

As desired, primary seal assembly 150 and/or secondary seal assembly 250 may be configured to form a static seal at inner seal 164, 264 and a dynamic seal at outer seal 163, 263 in accordance with embodiments of the present invention. For instance, in the embodiment illustrated in FIG. 14, seal body 160 of primary seal assembly 150 may be configured to include a dynamic inner seal 164 and static outer seal 163, while seal body 260 of secondary seal assembly 250 may be configured to include a static inner seal 264 and dynamic outer seal 263 in accordance with embodiments of the present invention. It should be appreciated that with two seal assemblies 150, 250, there are at least four potential arrangements as follows: (1) dynamic inner seal 164 and dynamic inner seal 264; (2) dynamic inner seal 164 and static inner seal 264; (3) static inner seal 164 and dynamic inner seal 264; and (4) static inner seal 164 and static inner seal 264.

In general, dynamic seals generate more thermal energy than static seals. This is due primarily to heat generated by friction resulting from rotation against cone surfaces (e.g., sealing surface 152) or journal surfaces (e.g., journal shaft bearing surface 42). Consequently, temperatures at dynamic seals and regions adjacent dynamic seals tend to be higher than temperatures at static seals and regions adjacent static seals. Heat generation, and resulting temperatures, adjacent sealing surfaces are preferably controlled to improve drill bit performance and life. For instance, temperatures in excess of about 250° to 300° F. may lead to premature breakdown and failure of elastomeric seal bodies. Temperature increases may also cause seal bodies (e.g., seal body 160, seal body 260) to expand, potentially increasing engagement with the recess (e.g., recess 134, recess 234) within which they are disposed. Such increases in engagement between the seal body and the recess from expansion may result in undesirable increases in frictional forces and further temperature increases. In addition, excessive journal shaft temperatures may lead to premature breakdown and failure of the lubricating grease that flows between the rolling cone cutter and the journal shaft.

Excessive heat generation and temperatures may especially be a concern in conventional multi-seal arrangements in which adjacent seal assemblies include seal bodies each having a dynamic sealing surfaces at their inner diameter dynamically engaging the journal shaft. In such cases, the heat generated by the relatively close dynamic seals tends to increase the temperature of the journal shaft more than a single dynamic seal would alone. However, by configuring adjacent seal assemblies such that one seal body forms a dynamic seal at its inner diameter with the journal shaft, while the other seal body forms a static seal at its inner diameter with the journal shaft, embodiments described herein offer the potential to improve heat distribution in multi-seal arrangements.

For instance, to enhance temperature distribution in multi-seal arrangement 200, adjacent seal bodies 160, 260 preferably do not each have dynamic inner seals 164, 264 or dynamic outer seals 162, 262. Rather, if primary seal assembly 150 includes a seal body 160 having a dynamic inner seal 162, it is preferred that adjacent secondary seal assembly 250 include a seal body 260 having a static inner seal 262, or vice versa.

Although seal bodies 160, 260 are each shown as comprising three materials, it should be appreciated that seal bodies 160, 260 may each comprise one or more materials. Further, seal bodies 160, 260 may each comprise the same or different materials.

Although seal assembly 50 illustrated in FIG. 2 is shown as being positioned between journal shaft 18 and cone 14 proximal backface 22 of cone 14, in general, embodiments of the seal assemblies described herein may be used in any suitable location to seal between a journal shaft and cone cutter of a rolling cone drill bit. In addition, embodiments of seal assemblies described herein are not limited to sealing within rolling cone drill bits, but in general, may be used to seal between any shaft and rotatable member that rotates about the shaft.

In the manner described, embodiments of the seal assemblies, drill bits, and methods of sealing between two rotating bodies described herein offer the potential to provide several improvements over prior art seals. In particular, by positioning the dynamic sealing surface of the seal body at the outer diameter of the seal body within a recess, embodiments described herein offer the potential to increase the resistance to the flow of cutting-laden drilling fluid to the dynamic seal, to reduce the likelihood of extrusion and nibbling of the seal body, and improve the lubrication of the dynamic seal while restricting leakage of drill bit lubricant. In addition, in multi-seal arrangements, by forming a dynamic seal at the inner diameter of the primary seal assembly and a static seal at the inner diameter of the secondary seal assembly, or vice versa, embodiments described herein may beneficially reduce journal shaft temperatures. Consequently, one or more of the potential benefits offered by embodiments of the present invention may result in longer periods of time between seal body failure, improved drill bit lubrication, and improved drill bit life.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A seal assembly for sealing between a journal shaft and a rotating cone cutter of a drill bit comprising:

a seal gland positioned between the journal shaft and the cone cutter, wherein the seal gland comprises an annular recess in the cone cutter and an outer bearing surface of the journal shaft;

wherein the annular recess includes a sealing surface distal the outer bearing surface of the journal shaft, a first annular surface extending from the sealing surface to an inner bearing surface of the cone cutter, and a second annular surface extending from the sealing surface to the inner bearing surface of the cone cutter;

an annular seal body disposed about the journal shaft within the annular recess, wherein the seal body comprises a dynamic sealing surface at an outer diameter $D_1$ of the seal body that forms a dynamic seal with the sealing surface of the recess, a static sealing surface at an inner diameter $D_2$ of the seal body that forms a static seal with the outer bearing surface of the journal shaft distal the sealing surface of the annular recess.

2. The drill bit of claim 1 wherein the seal body is radially compressed between the sealing surface of the annular recess and the outer bearing surface of the journal shaft.

3. The seal assembly of claim 1 wherein the journal shaft has as an outer diameter $D_3$ that is greater than the inner diameter $D_2$ of the seal body when the seal body is in its undeformed state.

4. The seal assembly of claim 1 wherein the sealing surface of the recess comprises a cylindrical shaft-facing surface.

5. The seal assembly of claim 4 wherein the recess has an outer diameter $D_4$ defined by the cylindrical shaft-facing surface that is greater than the outer diameter $D_1$ of the seal body when the seal body is in its undeformed state.

6. The seal assembly of claim 1 wherein the seal body further comprises a pair of sidewalls extending between the dynamic sealing surface and the static sealing surface, wherein the seal body has a width $W_1$ between the sidewalls and the recess has a width $W_2$ between the first and second annular surfaces, wherein the width $W_2$ of the recess is greater than the width $W_1$ of the seal body when the seal body is in its undeformed state.

7. The seal assembly of claim 1 wherein the seal body comprises an elastomeric material.

8. The seal assembly of claim 7 wherein the elastomeric material has a durometer Shore A hardness between 60 and 95A.

9. The seal assembly of claim 7 wherein the dynamic sealing surface of the seal body comprises a non-elastomeric wear resistant material.

10. The seal assembly of claim 9 wherein the static sealing surface of the seal body comprises an elastomeric wear resistant material.

11. The seal assembly of claim 9 wherein the non-elastomeric wear resistant material is a fabric.

12. The seal assembly of claim 1 wherein the seal body comprises at least two different materials.

13. The seal assembly of claim 12 wherein the seal body includes a radially outer portion that includes the dynamic sealing surface, a radially inner portion that includes the static sealing surface, and a middle portion between the radially outer portion and radially inner portion, wherein the radially outer portion comprises a first material, the middle portion comprises a second material, and the radially outer portion comprises a third material that is different from the first material and the second material.

14. The seal assembly of claim 13 wherein the first material and the third material comprise elastomeric wear resistant materials and the second material comprises an elastomeric material that is softer than the first material and the third material.

15. The seal assembly of claim 13 wherein the first material comprises a wear resistant non-elastomeric fabric.

16. The seal assembly of claim 1 wherein the static sealing surface of the seal body is bonded to the journal shaft bearing surface by a bonding agent.

17. The seal assembly of claim 16 wherein the bonding agent is selected from a group consisting of a phenolic resin, a phenolic resin and chlorinated polymer combination, or silane.

18. The seal assembly of claim 1 wherein the seal body comprises an axially extending flange that sealingly engages the outer surface of the journal shaft.

19. The seal assembly of claim 1 wherein the dynamic sealing surface of the seal body comprises a radially extending annular peak that engages the sealing surface of the recess.

20. A drill bit for drilling through earthen formations comprising:

a bit body including an extending journal shaft having an outer bearing surface;

a rolling cone cutter rotatably mounted on said journal shaft, wherein the rolling cone cutter includes an inner bearing surface adjacent the outer bearing surface of the journal shaft;

a first seal assembly positioned between the rolling cone cutter and the journal shaft comprising:

a first annular recess formed in the inner bearing surface of the rolling cone cutter, the first annular recess including a cylindrical sealing surface distal the outer bearing surface of the journal shaft, a first planar annular surface extending from the sealing surface to the inner bearing surface of the cone cutter, and a second planar annular surface parallel to the first planar annular surface and extending from the sealing surface to the inner bearing surface of the cone cutter; and a first annular seal body positioned around the journal shaft within the first annular recess, wherein the first annular seal body comprises a radially outer dynamic sealing surface that sealingly engages the sealing surface of the first annular recess and a radially inner static sealing surface that sealingly engages the outer bearing surface of the journal shaft.

21. The drill bit of claim 20 wherein the first seal body is radially compressed between the sealing surface of the first recess and the outer bearing surface of the journal shaft.

22. The drill bit of claim 20 wherein the first seal body has an inner diameter $D_1$ and the journal shaft has an outer diameter $D_3$, wherein the outer diameter $D_3$ of the journal shaft is greater than the inner diameter $D_1$ of the first seal body when the first seal body is in its undeformed state.

23. The drill bit of claim 20 wherein the first seal body has an outer diameter $D_2$ and wherein the first recess has an outer diameter $D_4$ defined by the cylindrical shaft-facing surface, wherein the outer diameter $D_4$ of the first recess is greater than the outer diameter $D_2$ of the first seal body when the first seal body is in its undeformed state.

24. The drill bit of claim 20 wherein the seal body further comprises a pair of sidewalls extending between the radially outer dynamic sealing surface and the radially inner static sealing surface, wherein the first seal body has a width $W_1$ between the sidewalls and the first recess has a width $W_2$ between the annular surfaces, and wherein the width $W_2$ of the first recess is greater than the width $W_1$ of the first seal body when the first seal body is in its undeformed state.

25. The drill bit of claim 20 wherein the first seal body comprises a radially outer portion made of a first material, a radially inner portion made of a third material, and a middle portion between the radially outer portion and the radially inner portion comprising a second material.

26. The drill bit of claim 25 wherein the second material is softer than the first material and the third material.

27. The drill bit of claim 26 wherein the first material and the third material are wear resistant elastomeric materials.

28. The drill bit of claim 26 wherein the first material is a wear resistant non-elastomeric fabric.

29. The drill bit of claim 20 wherein the radially inner static sealing surface of the first seal body is bonded to the outer bearing surface of the journal shaft by a bonding agent.

30. The drill bit of claim 29 wherein the bonding agent is selected from a group consisting of a phenolic resin, a phenolic resin and chlorinated polymer combination, or silane.

31. The drill bit of claim 20 further comprising a second seal assembly between the rolling cone cutter and the journal shaft and axially spaced apart from the first seal assembly, wherein the second seal assembly comprises:

a second annular recess formed in the inner bearing surface of the rolling cone cutter, the second annular recess includes a sealing surface; and a second annular seal body positioned around the journal shaft disposed within the second annular recess, wherein the second annular seal body comprises a radially outer sealing surface that sealingly engages the shaft-facing surface of the second annular recess and a radially inner sealing surface that sealingly engages the outer surface of the journal shaft.

32. The drill bit of claim 31 wherein the radially outer sealing surface of the second seal body forms a static seal with the sealing surface of the second recess and the radially inner sealing surface of the second seal body forms a dynamic seal with the outer surface of the journal shaft.

33. The drill bit of claim 31 wherein the second annular seal body has an inner diameter $D_1$ and the journal shaft as an outer diameter $D_3$, wherein the inner diameter $D_1$ of the second annular seal body when the second annular seal body is in its undeformed state is less than the outer diameter $D_3$ of the journal shaft.

34. The drill bit of claim 31 wherein the first annular seal body comprises three materials and the second annular seal body comprises three materials.

35. A seal assembly for sealing between a journal shaft and a rotating cone cutter of a drill bit comprising:

an annular recess in an inner surface of the cone cutter, the annular recess including a sealing surface distal an outer bearing surface of the journal shaft;

an annular passage extending between the outer surface of the journal shaft and the inner surface of the cone cutter;

an annular seal body disposed about the journal shaft within the annular recess, wherein the seal body comprises a radially outer dynamic sealing surface distal the annular passage and a radially inner static sealing surface proximal the annular passage;

wherein the dynamic sealing surface forms a dynamic seal with the sealing surface of the annular recess and the static sealing surface forms a static seal with the outer bearing surface of the journal shaft; and wherein the radially outer sealing surface comprises a first material with a first coefficient of friction and the radially inner sealing surface comprises a second material with a second coefficient of friction that is greater than the first coefficient of friction.

36. The seal assembly of claim 35 wherein the first material comprises a wear resistant non-elastomeric fabric and the second material comprises an elastomeric material.

37. The seal assembly of claim 35 wherein the seal body has an inner diameter $D_1$ and the journal shaft as an outer diameter $D_3$, wherein the outer diameter $D_3$ of the journal shaft is greater than the inner diameter $D_1$ of the seal body when the first seal body is in its undeformed state.

38. The drill bit of claim 35 wherein the first seal body has an outer diameter $D_2$ and wherein the first recess has a maximum outer diameter $D_4$ defined by the sealing surface, wherein the outer diameter $D_4$ of the recess is greater than the outer diameter $D_2$ of the seal body when the seal body is in its undeformed state.

* * * * *